US005923935A

United States Patent [19]

Yamaguchi

[11] Patent Number: 5,923,935

[45] Date of Patent: Jul. 13, 1999

[54] IMAGE FORMING APPARATUS WITH A FOLDING TRANSFER DEVICE SUPPORT MEMBER

[75] Inventor: Toshitaka Yamaguchi, Ohmiya, Japan

[73] Assignee: Ricoh Company, Ltd., Tokyo, Japan

[21] Appl. No.: 08/777,086

[22] Filed: Dec. 30, 1996

[30] Foreign Application Priority Data

| | | | |
|---|---|---|---|
| Dec. 29, 1995 | [JP] | Japan | 7-353171 |
| Dec. 30, 1995 | [JP] | Japan | 7-354158 |
| Dec. 30, 1995 | [JP] | Japan | 7-354159 |

[51] Int. Cl.[6] ..... G03G 15/16

[52] U.S. Cl. ..... 399/297; 399/21; 399/121

[58] Field of Search ..... 399/121, 297, 399/308, 312, 315, 21, 126

[56] References Cited

U.S. PATENT DOCUMENTS

| | | | |
|---|---|---|---|
| 4,116,556 | 9/1978 | Tanaka et al. | 399/121 |

FOREIGN PATENT DOCUMENTS

| | | |
|---|---|---|
| 52-75 444 | 6/1977 | Japan . |
| 60-176 453 | 11/1985 | Japan . |
| 1-195477 | 8/1989 | Japan . |
| 1-292 381 | 11/1989 | Japan . |
| 2-163776 | 6/1990 | Japan . |
| 6-348148 | 12/1994 | Japan . |

*Primary Examiner*—Arthur T. Grimley
*Assistant Examiner*—Quana Grainger
*Attorney, Agent, or Firm*—Oblon, Spivak, McClelland, Maier & Neustadt, P.C.

[57] ABSTRACT

An image forming apparatus which transfers a toner image formed on an image carrier to a recording medium with a transfer device and separates the recording medium from the image carrier by discharging the recording medium with a discharging device. The image forming apparatus includes a support member which supports the transfer device and which includes a first support element pivotally mounted to a main body of the apparatus and a second support element. The second support element is pivotally mounted to the first support element at one end and unattached at the other end. The second support element may be solely supported by the first support element. The first support element is supported from below and by pivoting a support member out from under the first support element, the transfer device moves between a working position facing a surface of the image carrier and a recessed position separated from the image carrier by a larger distance than when the transfer device is in the working position. A relatively large space is thus formed between the image carrier and the transfer device and clearance of a jammed sheet is facilitated. The transfer device is detachable from the second support element and the discharging device is also detachable from the second support element independently or integrally with the transfer device.

30 Claims, 18 Drawing Sheets

IMAGE FORMING APPARATUS WITH A FOLDING TRANSFER DEVICE SUPPORT MEMBER

BACKGROUND OF THE INVENTION

1. Field of the Invention

The present invention relates to an image forming apparatus which transfers a toner image formed on an image carrier to a recording medium with a transfer device and separates the recording medium from the image carrier by discharging to the recording medium by means of a discharging device. The invention is more particularly related to an image forming apparatus which includes a support member supporting the transfer device, which bends or folds at a hinged region to form a relatively large space between the transfer device and the image carrier for facilitating clearance of a jammed sheet 2. Discussion of the Background As an image forming apparatus which transfers a toner image formed on an image carrier to a recording medium with a transfer device and separates the recording medium from the image carrier by discharging the recording medium with a discharging device, there are known various image forming apparatuses such as a copying machine, a printer, a facsimile machine and a multi-function machine having copying, facsimile and printer functions. In these apparatuses, a recording medium which is a sheet is conveyed to a transfer area between an image carrier and a transfer device. A toner image formed on the image carrier is transferred to the recording medium using of the transfer device and the recording medium is then separated from the image carrier by discharging the recording medium using the discharging device.

While a recording medium is conveyed along a predetermined conveying path in these apparatuses, a paper jam or other conveying trouble sometimes occurs in the transfer area or in an area near the transfer area. Therefore, in a conventional image forming apparatus, a transfer device is generally constructed so as to be separable from the image carrier so that a recording medium jammed in the transfer area or in an area near the transfer area can be easily taken out of such areas. For example, a support member of a transfer device is mounted to a main body of an image forming apparatus so as to swing open relative to the main body. The transfer device is usually supported in a position facing the image carrier by this support member, and is separated from the image carrier when a recording medium is jammed in a transfer area or in an area near the transfer area, by swinging open the support member relative to the main body of the apparatus. The transfer device supported by the support member is thus separated from the image carrier to form a space between the transfer device and the image carrier, thereby enabling a person to insert his or her hands into that space for removing the recording medium which is jammed between the transfer device and the image carrier.

However, there are provided around the transfer device various elements such as a base plate of the main body of the apparatus, and it is rather difficult to form a large space between the transfer device and the image carrier for clearing a recording medium which is jammed in the transfer area or in the area near the transfer area, even when the support member of the transfer device is so constructed to swing open relative to the main body as described above. Especially, a size of recent image forming apparatus tends to become smaller and consequently, a space allowed for clearing a jammed recording medium tends to become narrower. It is not so easy to insert a hand into such a narrow space for clearing a jammed recording medium, and not only efficiency of clearing a jammed recording medium lowers but also there exist possibilities that the hands and clothes of an operator will be stained with toner, and also possibilities that parts of the apparatus are touched by the operator will become damaged.

Further, a transfer device which is constituted of, for example, a transfer roller contacting an image carrier or a corona charger facing and separated from an image carrier, when used for a long period of time, deteriorates in its properties. If such a deteriorated transfer device is continued to be used, an abnormal image is produced. Therefore, a transfer device needs to be regularly cleaned and checked, and be replaced with a new device when the expected life span of the device expires.

A conventional image forming apparatus is therefore so constructed that a transfer device is detached from its support member by pulling the transfer device towards a front position of the apparatus and is mounted to the support member of the transfer device by pushing back the transfer device toward a rear position of the apparatus. Namely, an operator pulls the transfer device towards a front position of the apparatus when cleaning or checking the transfer device or replacing the device with a new device, and pushes back the transfer device, after cleaning or checking the new device, towards a rear position of the apparatus to mount the transfer device to the support member.

With the above-mentioned construction, however, it is necessary to contain the transfer device in a holding case which is a separate unit from the support member for the transfer device and to mount the holding case detachably to the support member for the transfer device. Therefore, the number of parts increases and consequently the cost of the apparatus inevitably rises.

A discharging device also, when used for a long period of time, deteriorates in its property, and if such a deteriorated discharging device is continued to be used, an abnormal image is produced. Therefore, a discharging device also needs to be regularly cleaned and checked, and be replaced with a new device when the expected life span expires like a transfer device.

Therefore, in conventional image forming apparatuses, a transfer device and a discharging device are integrated in one unit so that the transfer device and the discharging device can be taken out of a main body of the apparatus integrally for repairing or replacement. The transfer device and the discharging device which are repaired, or a new transfer device and a new discharging device are integrally mounted to a main body of the apparatus.

Thus, even in a conventional image forming apparatus, a transfer device and a discharging device can be checked, cleaned or replaced with a new device when the expected life span is expired, because the transfer device and the discharging device are detachably mounted to a main body of the apparatus. However, a cycle of checking and cleaning or replacement of a transfer device is generally different from that of a discharging device, and the cycle of the discharging device is generally shorter than that of the transfer device. In such a case, it occurs that the transfer device needs not to be replaced with a new device because the life span is not yet expired when the discharging device needs to be replaced with a new device because of expiration of its life span.

In such a case, with the above-mentioned image forming apparatus, the discharging device cannot be removed alone from the main body of the apparatus for replacement because the transfer device and the discharging device are assembled integrally and mounted to the main body of the apparatus as an integrated unit.

When only the discharging device needs to be cleaned also, the transfer device which needs not be cleaned has to be removed from the main body of the apparatus and unnecessary work is forced.

Further, there is a known image forming apparatus in which a transfer device and a discharging device are individually mounted to a main body of the apparatus so that these devices can be detached from the main body individually. With such an image forming apparatus, when the life span of the transfer device is not expired and only the life span of the discharging device is expired, the discharging device alone can be detached from the apparatus for replacement. Namely, either the discharging device or the transfer device can be checked, cleaned or replaced with a new device.

With the above-mentioned construction, however, a transfer device and a discharging device have to be removed from a main body of the apparatus individually and therefore, when both devices need to detached from the apparatus, work for detaching these devices from the apparatus is complicated and work efficiency lowers. For example, when the life spans of the transfer device and the discharging device are both expired or both devices need to be checked and cleaned, these devices have to be detached from the apparatus individually and such work is onerous.

SUMMARY OF THE INVENTION

The present invention has been made in view of such problems and to address and resolve these problems.

Accordingly, an object of the present invention is to provide a novel image forming apparatus which is capable of forming a large space for clearing a recording medium which is jammed between a transfer device and an image carrier and facilitates clearing of such a jammed recording medium without increasing a size of the apparatus.

Another object of the present invention is to provide a novel image forming apparatus in which a transfer device is so constructed to be easily detachable from the apparatus with a simple construction.

Still another object of the present invention is to provide a novel image forming apparatus in which a transfer device and a discharging device are integrated so as to be detachable from the apparatus integrally, and further, the discharging device is independently detachable from the apparatus.

In order to achieve the above-mentioned first object, an image forming apparatus which transfers a toner image formed on an image carrier to a recording medium with a transfer device and separates the recording medium from the image carrier by discharging the recording medium using a discharging device is provided with a support member which supports the transfer device. The transfer device includes a first support element movably mounted to a main body of the apparatus and a second support element movably mounted to the first support element so as to move the transfer device between a working position facing a surface of the image carrier and a recessed position separated from the image carrier by a larger distance than when the transfer device is in the working position.

The first support element may be rotatably mounted to the main body of the apparatus at one end and the second support element may be rotatably mounted to a free end of the first support element so as to move the transfer device between a working position facing a surface of the image carrier and a recessed position separated from the image carrier by a larger distance than when the transfer device is in the working position.

The second support element rotates relative to the first support element in a direction that an angle which is formed with each side of the first and the second support elements facing the image carrier when the transfer device is in a working position is narrowed when the transfer device is in a recessed position separated from the image carrier by a larger distance than when the transfer device is in the working position The image forming apparatus of this invention further includes a support element hold device which holds the above-mentioned support member so as to hold the transfer device in a working position and moves to a position to allow the support member to rotate when moving the transfer device to a recessed position.

It is preferable in this invention that the transfer device is mounted to the second support element Further, it is preferable that the transfer device is a transfer roller which rotates when contacting the image carrier via a recording medium when transferring a toner image.

The image forming apparatus of this invention may further include a device to prevent the second support element from rotating in a direction to separate from the image carrier relative to the first support element when the transfer device is in a working position. It is preferable that when the transfer device is in a recessed position, the second support element is supported by a base plate of the main body of the apparatus, which is located below the image carrier, so that the second support element rotates in a direction to be bent relative to the first support element and to narrow an angle formed by each side of the first and the second support elements facing the image carrier.

It is further preferable that a relative position between the second support element and the base plate is set that the second support element takes a posture substantially in parallel with the base plate when the transfer device is in a recessed position.

The image forming apparatus of this invention may further include a device to reduce a frictional force working on the second support element from a side of the main body of the apparatus for accelerating rotation of the second support element relative to the first support element in a direction to narrow an angle formed by each side of the first and the second support elements facing the image carrier when the transfer device moves to a position near a recessed position from a working position.

Further, the image forming apparatus of this invention may include an inner cover covering an opening provided at the front side of the apparatus and a relative position between the second support element and the inner cover may be set so that an upper part of the transfer device is positioned at approximately the same height as an upper end part of the inner cover when the transfer device is in a recessed position.

Still further, the image forming apparatus according to the present invention may include a device to position the second support element relative to the main body of the apparatus when the transfer device is in a working position.

Furthermore, the second support element may constitute a first guide plane to guide a recording medium conveyed to a transfer area between the transfer device and the image carrier, and the first support element may constitute a second guide plane to guide a recording medium which passes the transfer area between the transfer device and the image carrier.

Further, it is preferable that a tangent line contacting both the transfer roller and the image carrier in the transfer area crosses the second guide plane of the first support element, a part of the second guide plane in the upper stream of the crossing point in a traveling direction of a recording medium is in a position below the tangent line and the transfer area and a part of the second guide plane in the downstream of the crossing point in the traveling direction of a recording medium is in a position above the tangent line.

Furthermore, in order to achieve the above-mentioned second object, in the image forming apparatus of this invention, the second support element is made to be detachable from the first support element.

It is preferable in this invention that a connecting device detachably connecting the second support element to the first support element is so constructed as to be detachable only when an angle formed by the first and the second support elements become narrower than an angle formed when the first and the second support elements are in a recessed position. Further, a guide member which guides the second support element when connecting the second support element with the first support element may be provided at the main body side of the apparatus.

Still further, a protecting cover detachably mounted to the second support element for protecting the transfer device may serve as such a guide member to guide the second support element when connecting the second support element with the first support element.

Furthermore, an obstructing member which obstructs the first support element to rotate when the second support element is not correctly engaged with the first support element may be provided at the main body side. The above-mentioned guide member guiding the second support element when connecting the second support element with the first support element may serve as such an obstructing member.

Further, in order to achieve the aforementioned third object, in the image forming apparatus of this invention the discharging device is detachably mounted to the second support element.

Furthermore, a pushing device which, when the discharging device is not correctly mounted to the second support element, contacts with the discharging device and pushes the discharging device to a correct position relative to the second support element with movement of the first support element is provided.

Still furthermore, the transfer device may be detachably mounted to the second support element.

BRIEF DESCRIPTION OF THE DRAWINGS

A more complete appreciation of the present invention and many of the attendants advantages thereof will be readily obtained as the same becomes better understood by reference to the following detailed description when considered in connection with the accompanying drawings, wherein:

FIG. 11(*b*) is a schematic drawing illustrating a state in which the connecting pin is removable from the receiving part;

FIG. 15(*b*) illustrates the transfer device implemented as a blade;

DESCRIPTION OF THE PREFERRED EMBODIMENTS

Figure 1:
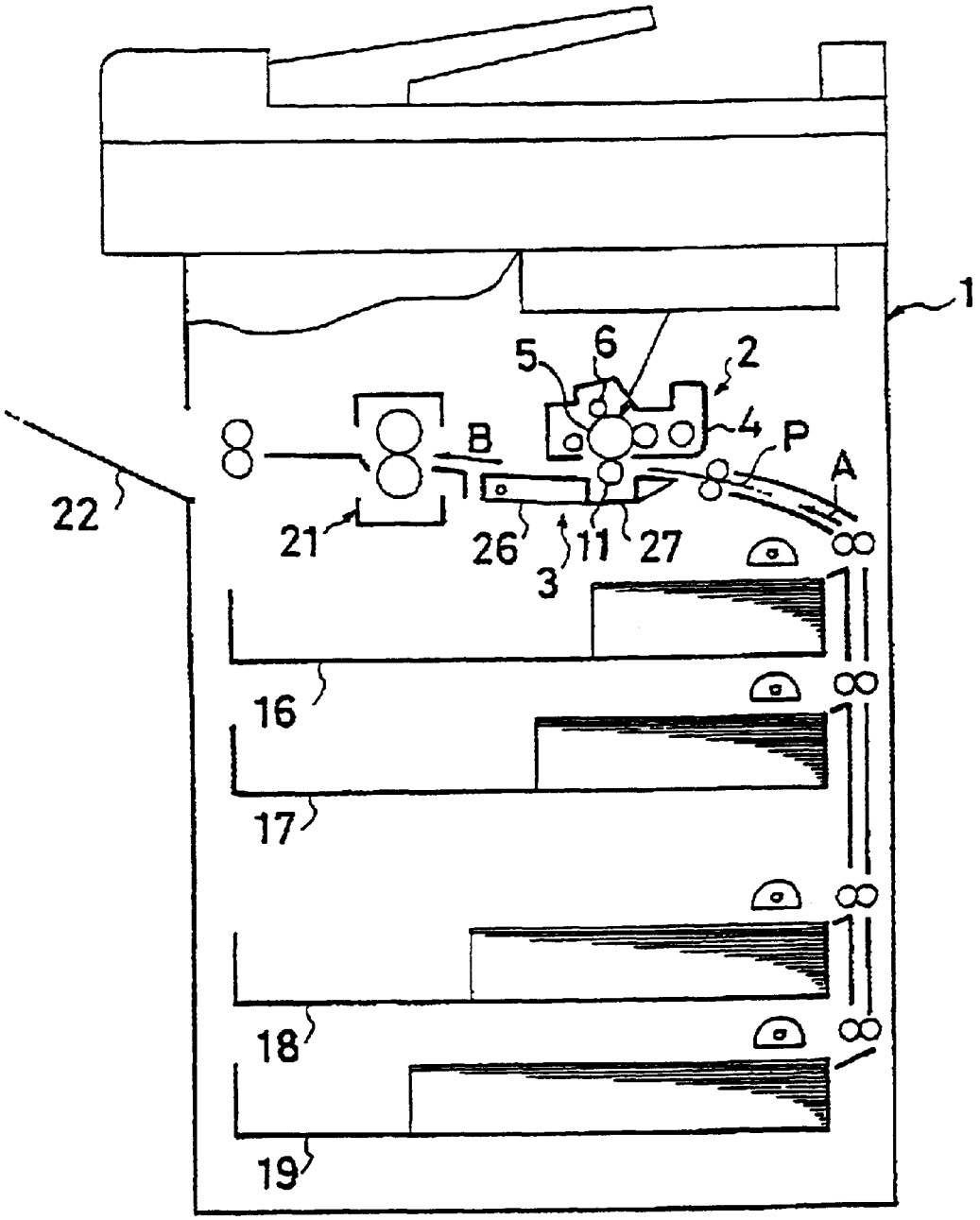
FIG. 1 is a schematic sectional drawing from the front illustrating an example of an internal structure of an image forming apparatus according to the present invention.

Referring now to the drawings, wherein like reference numerals designate identical or corresponding parts throughout the several views, and more particularly to FIG. 1 thereof, there is illustrated a schematic sectional from the front view of an example of an internal structure of an image forming apparatus according to the present invention. An image forming unit 2 is detachably mounted to a main body 1 of the apparatus. The image forming apparatus shown in the drawing is constructed as a copying machine, and it is possible to incorporate such functions as a printer and a facsimile machine in this copying machine. The front side of the apparatus is where an operator is normally positioned to operate the apparatus and the opposite side is a rear or back side of the apparatus. The image forming unit 2 is mounted to the main body of the apparatus from the front side of the apparatus and is accessible by an operator from the front after opening a door on the exterior of the image forming apparatus.

Figure 2:
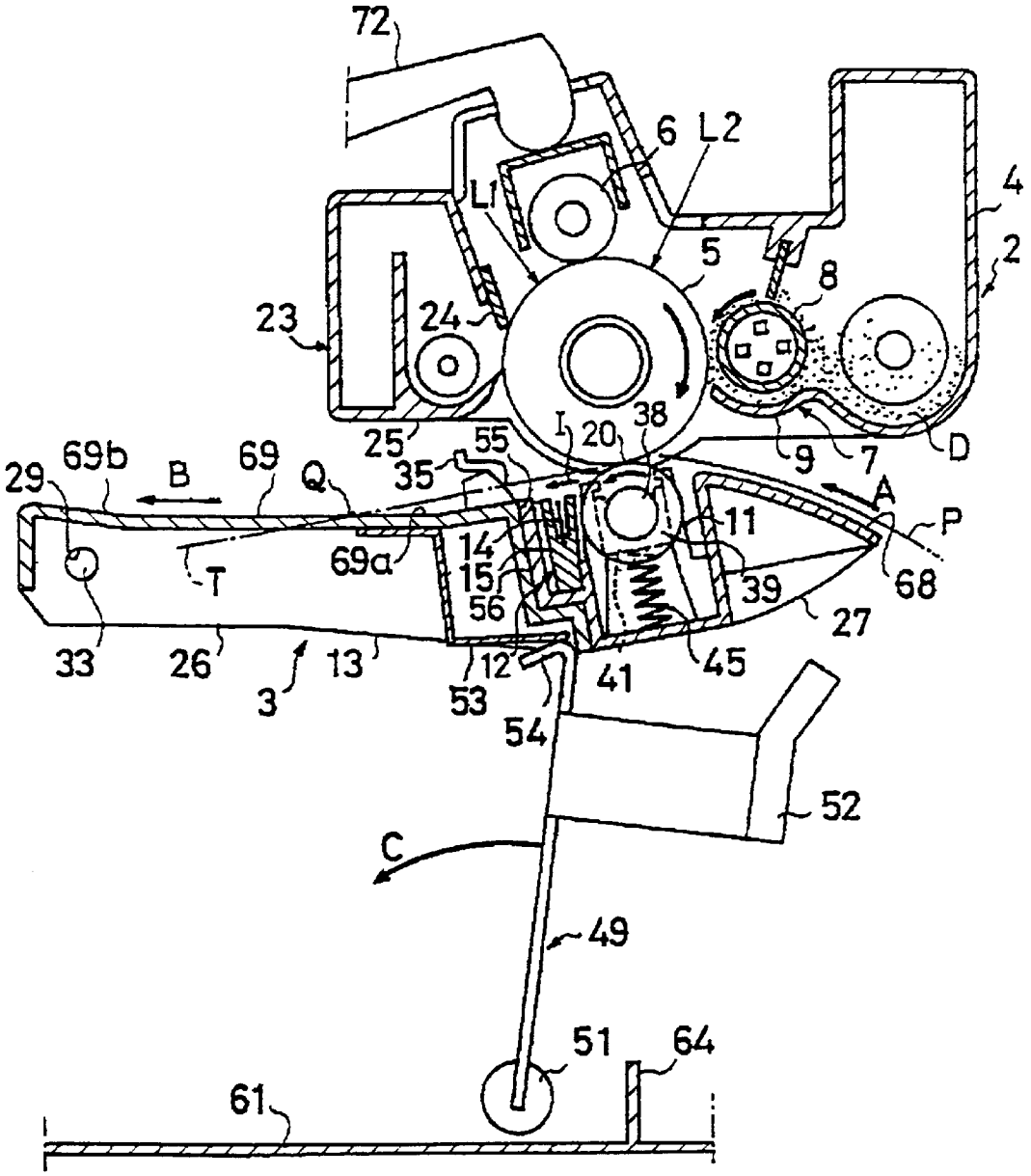
FIG. 2 is an enlarged sectional drawing illustrating an image forming unit and a transfer unit from the front.

FIG. 2 is an enlarged sectional drawing illustrating the image forming unit 2 and a transfer unit 3 from the front. As shown in FIGS. 1 and 2, the image forming unit 2 includes an unit case 4, and inside of the unit case 4 are a drum-shaped photoconductor 5 as an example of an image carrier and a charging roller 6 as an example of a charging device, both individually rotatably mounted to the unit case 4

During an image forming operation, the photoconductor 5 is driven clockwise by a driving unit such as motor, motor controller, and gears which are not shown in the drawings. A surface of the photoconductor 5 is discharged to a standard potential by a discharging light L1. The charging roller 6 is pressed against a surface of the photoconductor 5 and is rotated by frictional force between the charging roller 6 and the photoconductor 5 as the photoconductor 5 is driven. The charging roller 6 charges a surface of the photoconductor 5 uniformly with a predetermined polarity voltage. An optical image of an original or an optically modulated laser light L2 is applied to the charged surface of the photoconductor 5 to form thereupon an electrostatic latent image of the original. A developing roller 8 of a developing unit 7 is rotatably held by the unit case 4 as shown in FIG. 2, and developer D which is contained in a developing case 9 constituted as a part of the unit case 4 is carried on and conveyed by the developing roller 8 which is driven and rotated in a counter-clockwise direction. When the developer thus is conveyed to a position between the photoconductor 5 and the developing roller 8, toner in the developer is attracted to the electrostatic latent image formed on a surface of the photoconductor 5 and the latent image is developed to be a visible toner image.

Figure 15A:
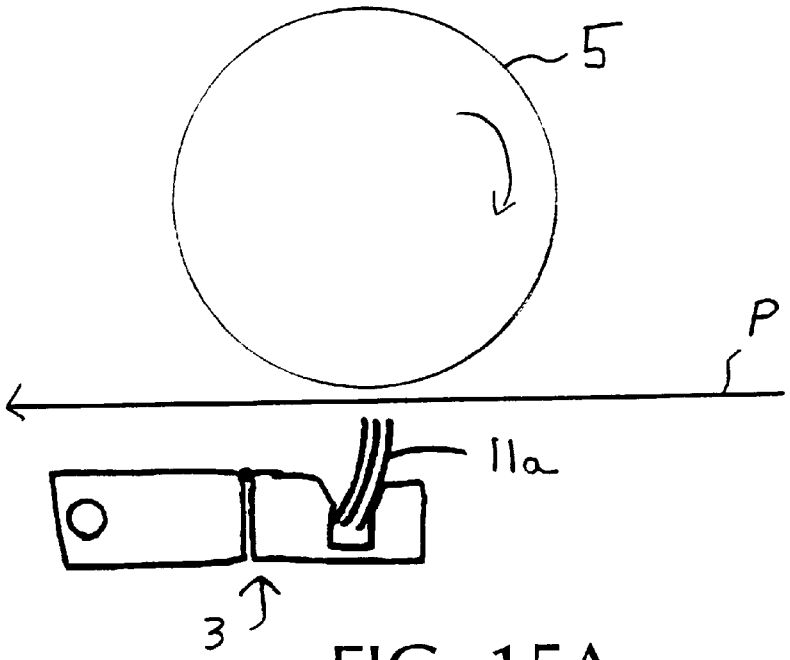
FIG. 15(*a*) illustrates the transfer device implemented as a brush.
Figure 15B:
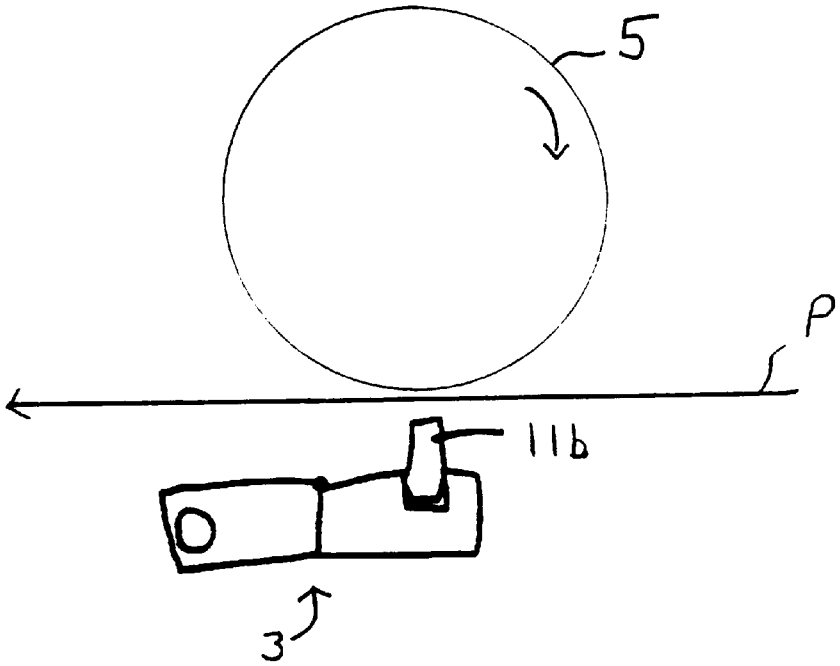

The transfer unit 3 includes a transfer device which is implemented, for example, as a roller 11 which extends in parallel to the photoconductor 5. Alternatively, the transfer device is implemented using a brush 11*a* as illustrated in FIG. 15A or as a blade 11*b* as illustrated in FIG. 15B which is made of rubber or a resin. Further, the transfer device may be implemented using any desirable manner. The transfer unit 3 further includes a discharging device 12 and a support member 13 which supports the transfer roller 11 and the discharging device 12. The discharging device 12 shown in the drawing as an example includes a discharging needle 14 extending in parallel with the photoconductor 5 and a holder 15 to support the discharging needle 14. The discharging needle 14 may be implemented as a piece of metal extending perpendicular to the paper path and include a series of protrusions (e.g., triangular or needle-like protrusions) which are used to discharge the paper. The transfer unit 3 is in a posture shown in FIG. 2 relative to the photoconductor 5 during an image forming operation in which the transfer roller 11 is in an operating position facing, and being pressed towards and contacting a surface of the photoconductor 5 while rotating in a counter-clockwise direction.

While a toner image is formed on a surface of the photoconductor 5 as described above, a sheet P, as an example of a recording medium which is paper or other desired material, for example, is conveyed from a feeding device selected from among a plurality of feeding devices 16, 17, 18 and 19 shown in FIG. 1 towards a transfer area 20 between the photoconductor 5 and the transfer roller 11 as indicated by an arrow. When the sheet P passes through the transfer area 20, the toner image formed on the surface of the photoconductor 5 is transferred onto the sheet P by a transfer voltage applied to the transfer roller 11.

The discharging device 12 is located downstream of the transfer roller 11 with respect to a traveling direction of the sheet P and the sheet P is separated from the photoconductor 5 by discharging the sheet P using the discharging needle 14 of the discharging device 12. The sheet P which has been separated from the photoconductor 5 and conveyed in a direction indicated by an arrow B passes through a fixing unit 21 illustrated in FIG. 1 and the toner image on the sheet P is fixed on the sheet P by heat and pressure from rollers of the fixing unit 21. The sheet P then exits from the main body of the apparatus as a copy sheet carrying a recorded toner image and is then stacked on an exit tray 22.

As illustrated in FIG. 2, toner remaining on the surface of the photoconductor 5 after transfer of the toner image is removed from the surface of the photoconductor 5 with a cleaning member or blade 24 of a cleaning unit 23 and then falls inside of a cleaning case 25 which is formed as a part of the unit case 4.

As described earlier, it is possible for the sheet P to be jammed in the transfer area 20 or in an area near the transfer area 20. Such a jammed sheet P needs to be cleared from the area, and for facilitating work of clearing such a jammed sheet P from the area 20, the transfer roller 11 has to be separated from the photoconductor 5 and a space for inserting a hand in order to take out the jammed sheet P from the area is required. If a large space can be formed for clearing the jammed sheet P, clearing the jammed sheet P becomes relatively easy. Conventional image forming apparatuses generally have a relatively small space for clearing a sheet P which is jammed in the transfer area 20 or in an area near the transfer area 20 clearing a jammed sheet P from such area has been relatively difficult with the conventional image forming apparatuses.

Figure 3:
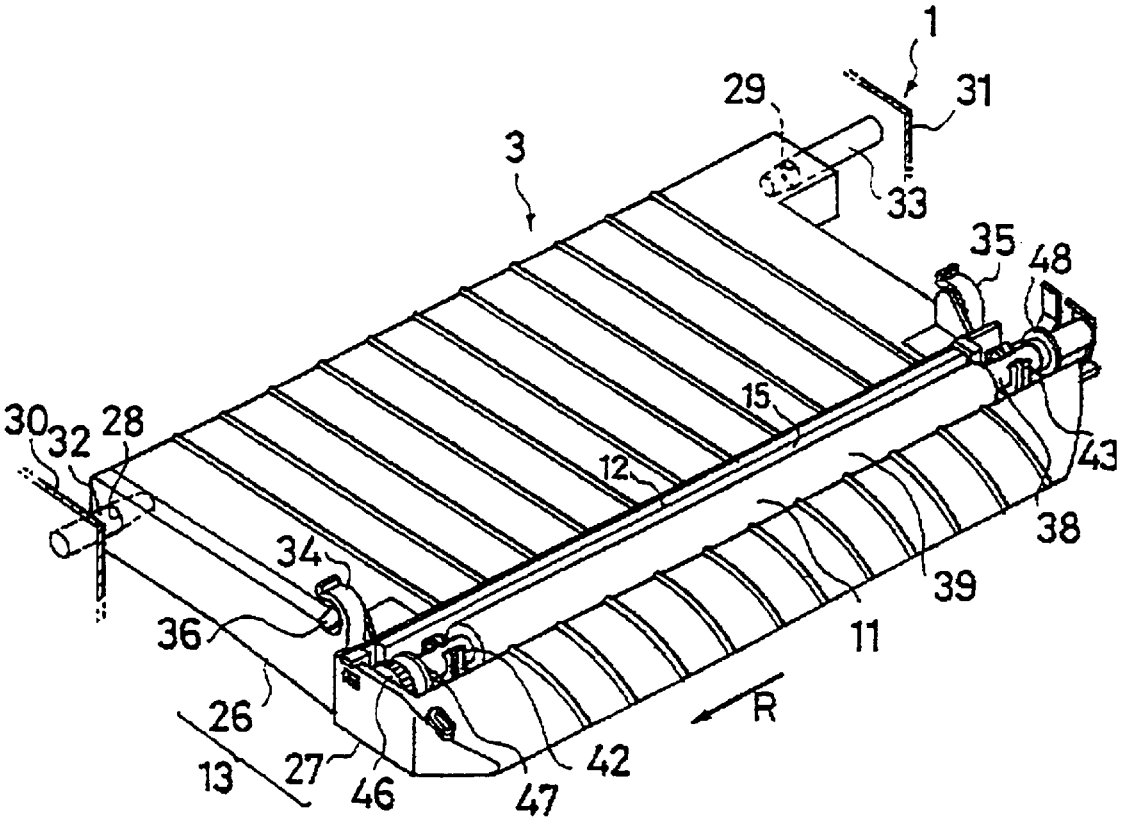
FIG. 3 is a perspective drawing illustrating the transfer unit.
Figure 4:
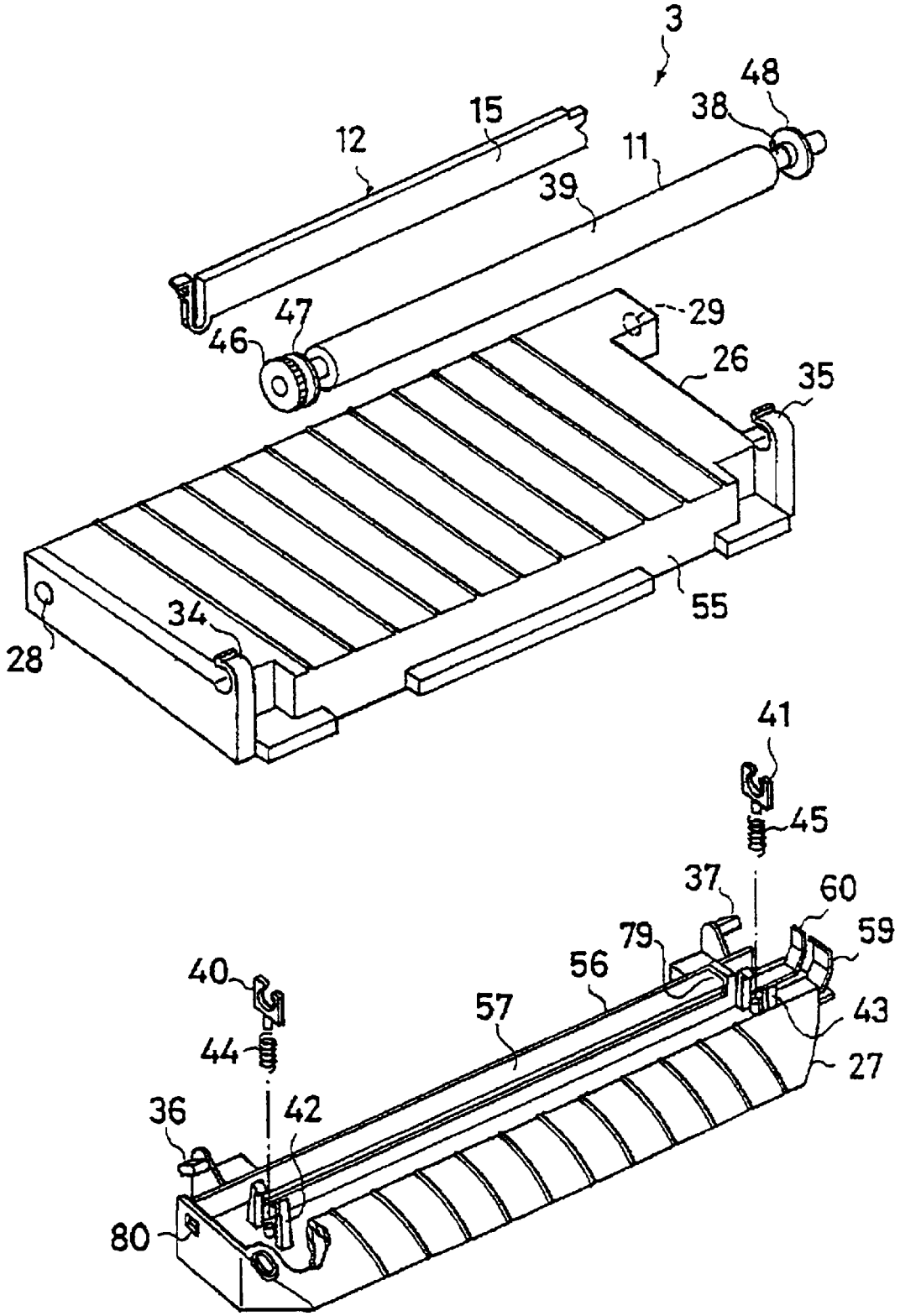
FIG. 4 is an exploded perspective drawing of the transfer unit.

FIG. 3 is a perspective drawing illustrating the transfer unit 3 and FIG. 4 is an exploded perspective drawing of the transfer unit 3 which forms a large space during a jam cleaning operation. As shown in these drawings and FIG. 2, the support member 13 supporting the transfer roller 11 as an example of a transfer device includes a first support element 26 and a second support element 27. In this embodiment, the first support element 26 is movably mounted to the main body 1 of the apparatus at one end so as to swing on that end side. Such an end side on which the first support element 26 swings is hereinafter called a base end side. The first support element 26 is provided with support holes 28 and 29 which are concentric at the front side and at the rear side of the base end side respectively. Support pins 32 and 33 respectively project from a front side plate 30 and a rear side plate 31 constituting a frame of the main body 1 of the apparatus and engage with the support holes 28 and 29, thereby rotatably supporting the first support element 26 around an axis of the support pins 32 and 33.

The support pins 32 and 33 which are mounting parts of the first support element 26 on the main body 1 of the apparatus are located downstream of the transfer area 20 with respect to a traveling direction of a sheet P, and an axis line of the support pins 32 and 33, namely the axis around which the first support element 26 swings, extends substantially parallel to an axis of the photoconductor 5. The first and second support elements 26 and 27 are made of, for example, hard plastics.

The second support element 27 is rotatably mounted to the free end side of the first support element 26 via a connecting device which includes as shown in FIG. 4 receiving parts 34 and 35 which are substantially arc-shaped and integrally project from the front side and the rear side of the free end side of the first support element 26 respectively. The second support element 27 further includes connecting pins 36 and 37 integrally projecting from the front side and the rear side of the second support element 27 respectively, and the connecting pins 36 and 37 rotatably engage with the receiving parts 34 and 35 respectively. A rotating axis of the second support element 27 relative to the first support element 26, namely a common axis line of the connecting pins 36 and 37, is parallel to the axis line of the photoconductor 5.

As shown in FIGS. 2 and 4, the transfer roller 11 includes an axis 38 made of a conductive material, for example, a metal, and a cylindrical elastic member 39 fixed around the axis 38. End portions of the front side and the rear side of the axis 38 are rotatably supported by axis receivers 40 and 41 respectively. The axis receivers 40 and 41 are held movably in a direction to separate from and contact the photoconductor 5 by axis receiver support parts 42 and 43 which are formed integrally with the second support element 27, and pressure springs 44 and 45 are provided between the axis receivers 40 and 41 and the second support element 27 respectively. A gear 46 is fixed to the axis 38 of the transfer roller 11 at the front side of the axis 38, and thrusting rollers 47 and 48 are rotatably mounted at both ends of the axis 38. Thus, in this embodiment, a transfer device constituted of the transfer roller 11 is mounted to the second support element 27 of the support member 13.

Further, as shown in FIG. 4, the holder 15 of the discharging device 12 is detachably mounted to a discharging device mounting part 57 of the second support element 27, described in detail below.

Figure 5:
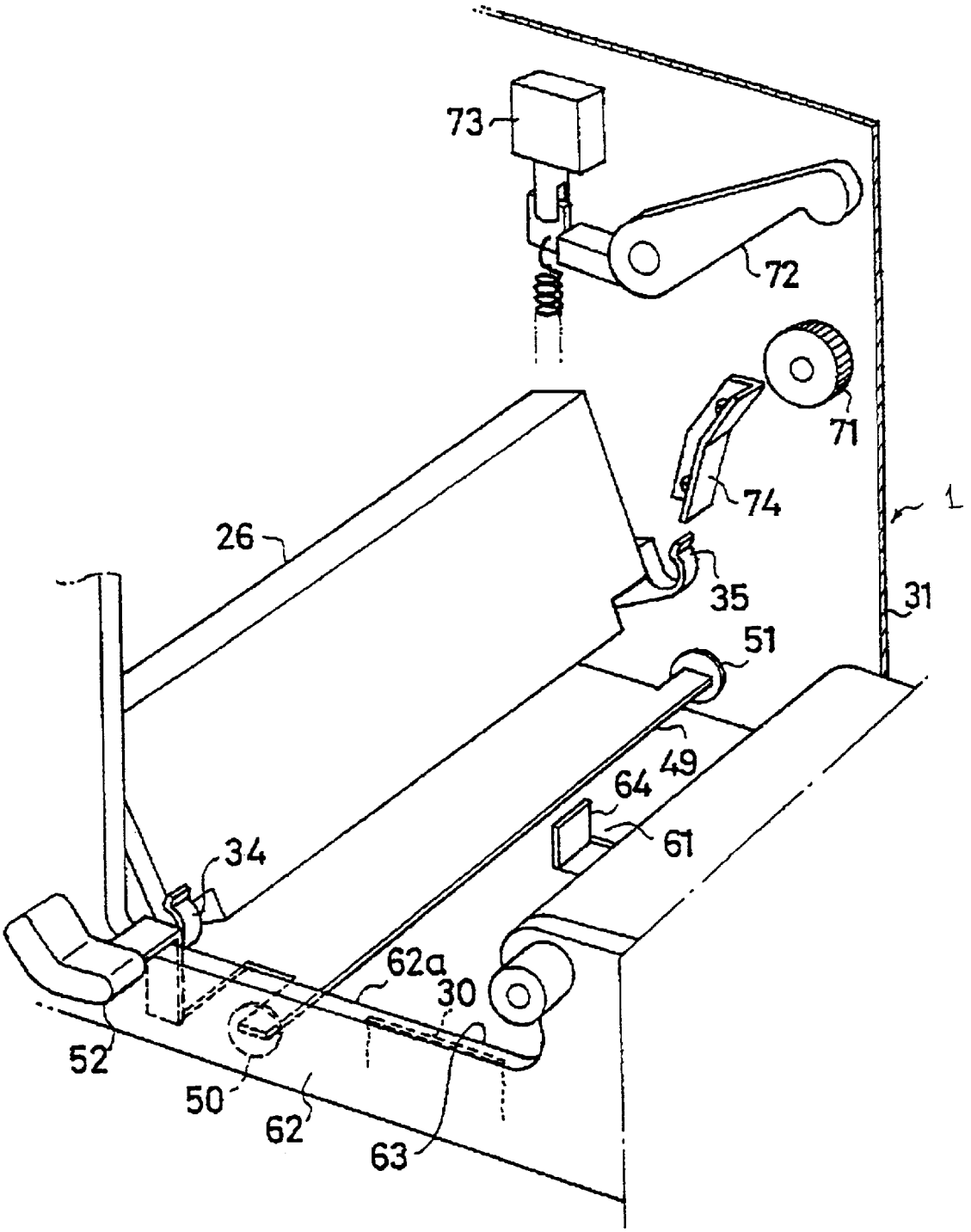
FIG. 5 is a perspective drawing illustrating a state in which the image forming unit is removed from a main body of the apparatus and a second support element is detached from a first support element and is removed from the main body of the apparatus.

As shown in FIGS. 2 and 5, a support member hold device 49 is provided below the support member 13, and the support member hold device 49 is held rotatably by the front side plate 30 and the rear side plate 31 via bearings 50 and 51 at parts of the front side and the rear side of the base end side of the support member hold device 49. The support member hold device 49 swings between a standing position shown in FIG. 2 and a lying position shown in FIGS. 5 and 6 around the base end side of the hold device 49. The support member hold device 49 includes a handle 52 provided integrally at a part of the front side.

As described earlier, at an image forming operation, the transfer roller 11 is in a working position to face and contact a surface of the photoconductor 5 as shown in FIG. 2 and the first and the second support elements 26 and 27 are also in a first position shown in FIG. 2. At this time, the support member hold device 49 is in a standing position shown in FIG. 2 and holds the support member 13 from below in order to hold the transfer roller 11 in the working position. As shown in FIG. 2, a base end part of a plate spring 53 is fixed to parts of the front side and the rear side of the first support element 26, and a top end part 54 of the support member hold device 49 is pressed to and contacts the free end side of the plate spring 53 to hold the first support element 26.

When the first support element 26 is held by the support member hold device 49 as described above, a side 55 of the first support element 26 and a side 56 of the second support element 26 are facing each other contact. By such contact, the second support element 27 is prevented from rotating relative to the first support element 26 around the connecting pins 36 and 37 in a clockwise direction in FIG. 2 to separate from the photoconductor 5.

Thus, the sides 55 and 56 of the first and second support elements 26 and 27, which face each other, constitute means for preventing the second support element 27 from rotating relative to the first support element 26 in a direction to separate from the image carrier constituted of the photoconductor 5 when the transfer device constituted of the transfer roller 11 is in the working position. By providing such means for preventing rotation of the second support element 27, both the first and the second support elements 26 and 27 are held securely in the first position and further the transfer roller 11 is held securely in the working position by means of such a simple structure as that the support member hold device 49 holds only the first support element 26 from below.

When the transfer roller 11 is in the working position as described above, the thrusting rollers 47 and 48 rotatably mounted at both ends of the axis 38 of the transfer roller 11 are thrusted respectively against the photoconductor 5 which is mounted to the unit case 4 of the image forming unit 2 at each end part relative to its axial direction to determine a position of the transfer roller 11 relative to the photoconductor 5. At this time, the elastic member 39 of the transfer roller 11 is pressed towards and is in contact with a surface of the photoconductor 5, and the pressure springs 44 and 45 which are deformed due to pressure, jointly with the axis receivers 44 and 45, press the transfer roller 11 to the photoconductor 5 to deform the elastic member 39.

Figure 7:
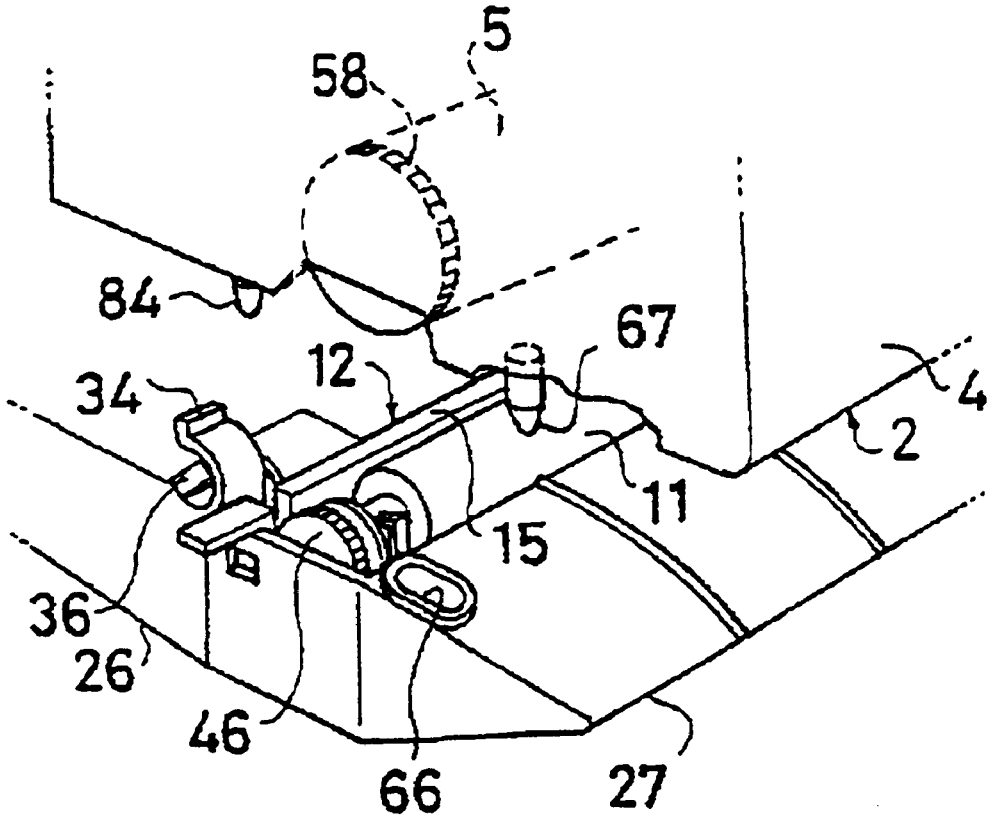
FIG. 7 is a perspective drawing illustrating a relative positional relation of the image forming unit and the transfer unit.

Further, the gear 46 engaging with the axis 38 of the transfer roller 11 engages with a gear 58 provided at an end part of the photoconductor 5 as shown in FIG. 7, and during an image forming operation, when the photoconductor 5 rotates, revolution of the photoconductor 5 is conveyed to the transfer roller 11 via the gears 58 and 46 to rotate the transfer roller 11 as described earlier.

Further, as shown in FIG. 4, an electrode 59 is fixed to the second support element 27, and when the second support element 27 is in the first position, the electrode 59 contacts an electrode which is not shown in the drawings and is provided on the main body side of the apparatus. The electrode 59 contacts the pressure spring 45 provided at the rear side, and this pressure spring 45 and the axis receiver 41 contacting the axis 38 of the transfer roller 11 are made of a conductive material. Therefore, during an image forming operation, a predetermined voltage is applied to the transfer roller 11 via the electrode 59, the pressure spring 45 and the axis receiver 41.

Figure 8:
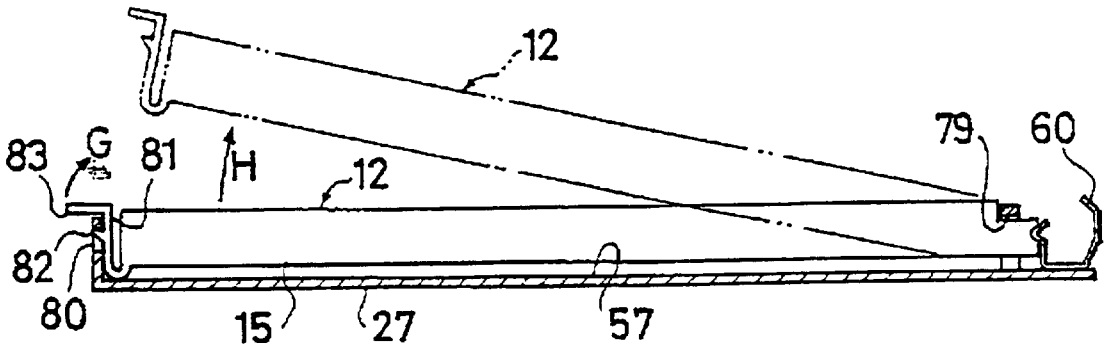
FIG. 8 is a schematic sectional drawing illustrating a discharging device and a relation with the second support element to which the discharging device is mounted.

The discharging needle 14 of the discharging device 12 includes a number of needle-shaped projections arranged in a longitudinal direction and projecting towards the photoconductor 5, and when the holder 15 is mounted to the discharging device mounting part 57 a part of the discharging needle 14 exposed from the holder 15 contacts an electrode 60 fixed to the second support element 27 as shown in FIG. 8. When the second support element 27 is in the first position, the electrode 60 contacts an electrode which is not shown in the drawings and is provided on the main body side of the apparatus, so that a predetermined voltage is applied to the discharging needle 14.

Figure 6:
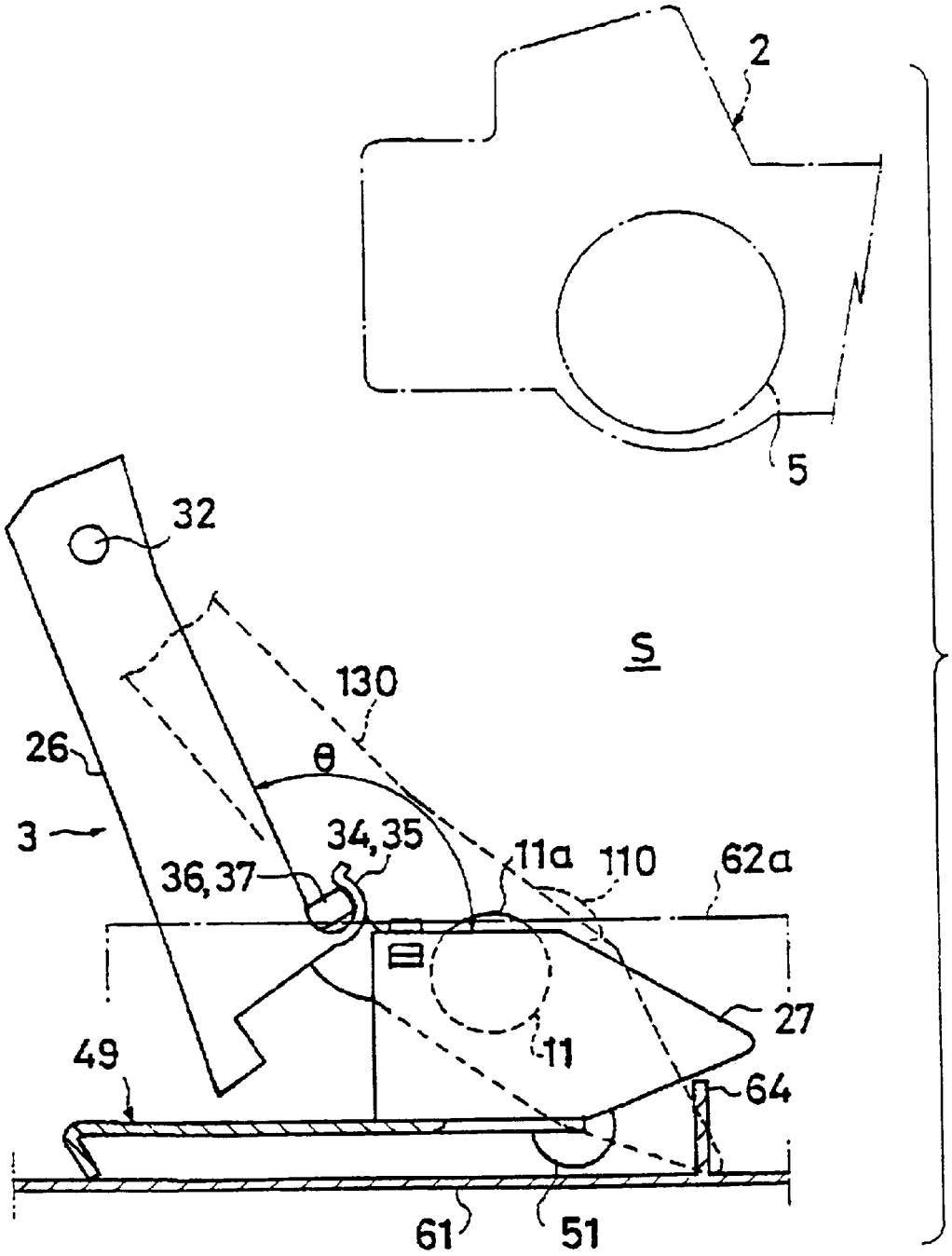
FIG. 6 is a schematic drawing illustrating a state in which the first and the second support elements are lowered to a recessed position.

When a sheet P is jammed at the transfer area 20 or an area near the transfer area 20, as explained above, the transfer roller 11 is moved to the position, as shown in FIG. 6, separated relatively far away from a surface of the photoconductor 5.

Figure 9:
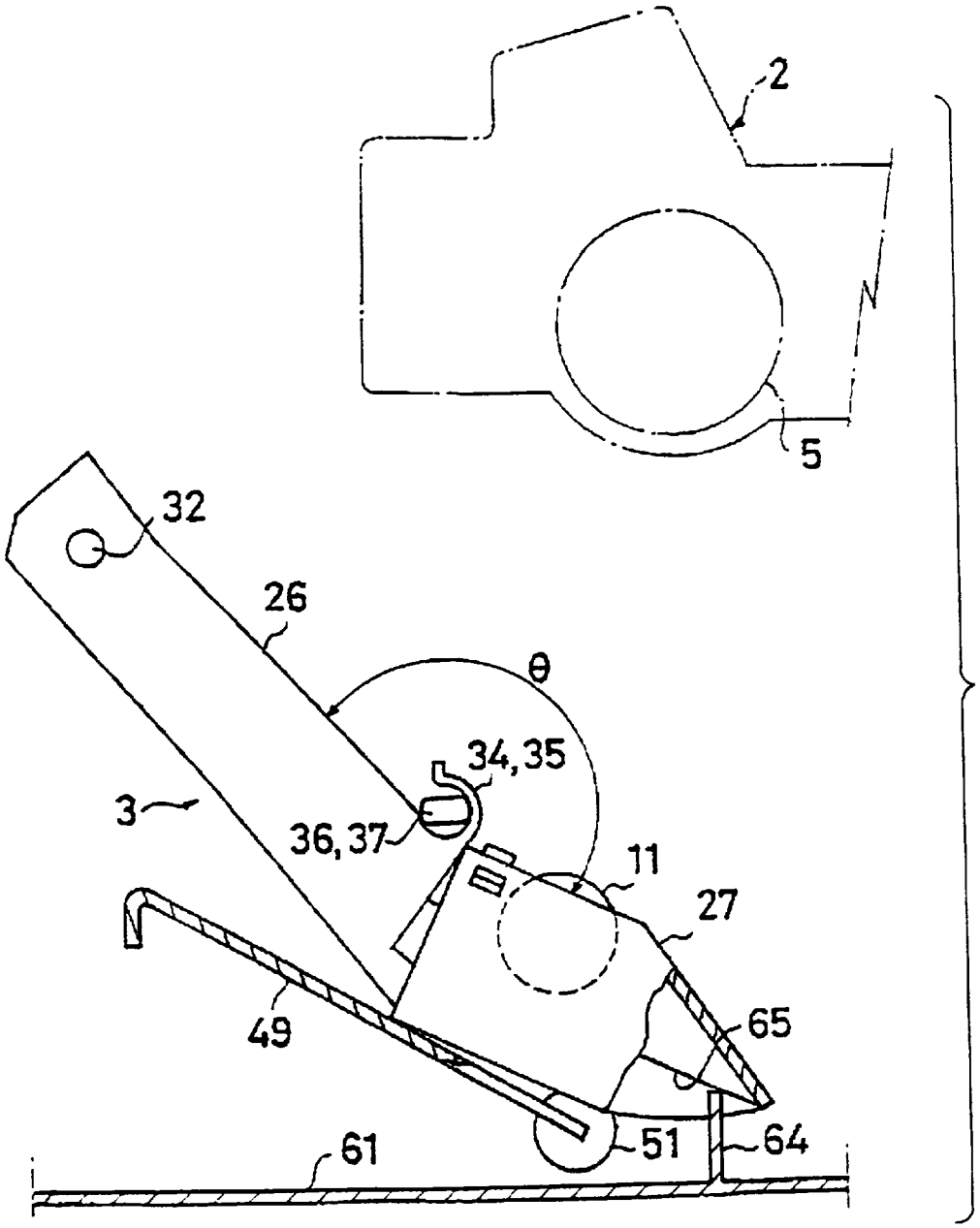
FIG. 9 is a schematic drawing illustrating an interim state of moving the first and the second support elements from a working position to a recessed position in an image forming apparatus which is provided with a projection to a base plate of the apparatus.

When a sheet P is jammed, an image forming operation stops and in this state an operator opens a front door of the main body 1 of the apparatus which is not shown in the drawings to expose the support member hold device 49 to be visible from outside of the apparatus. Then, the operator rotates the support member hold device 49 in a counterclockwise direction indicated by an arrow C in FIG. 2 around the base end side by holding the handle 52 and laying the support member hold device 49 as shown in FIG. 9 and bring the support member hold device 49 to a lying position shown in FIG. 6. With this movement of the support member hold device 49, the first support element 26 rotates or pivots due to its own weight around the support pins 32 and 34, the second support element 27 also moves jointly with the first support element 26, and consequently the transfer roller 11 separates from a surface of the photoconductor 5 to be in the recessed position shown in FIG. 6.

When the first and the second support elements 26 and 27 move to the second position shown in FIG. 6 as described above, because the second support element 27 is rotatably mounted to the first support elements 26, the second support element 27 pivots or bends relative to the first support element 26 as shown in FIG. 6. Thus, without enlarging an internal space of the main body of the apparatus, a relatively large space S is formed below the photoconductor 5 when the transfer roller 11 is in the recessed position. Consequently, an operator can easily remove a jammed sheet P by inserting his or her hands into such the space S, and further the operator can avoid touching the transfer roller 11 and the photoconductor 5 with his or her hands and clothes, staining his or her hands and clothes with toner and further, from putting an alien substance to the photoconductor 5.

After clearing the jammed sheet P, the operator holds the handle 52 and rotates the support element hold device 49 in a clockwise direction in FIG. 6, and with this rotation the first support element 26 and the second support element 27 are lifted to the first position to bring the transfer roller 11 to the working position facing the photoconductor 5. Thus, the image forming operation can be resumed.

As described above, in an image forming apparatus according to the present invention, the support member 13 supporting a transfer device constituted of the transfer roller 11 includes the first support element 26 mounted rotatably to the main body 1 of the apparatus at one end side and the second support element 27 rotatably mounted to the free end side of the first support element 26 so as to move the transfer roller 11 between a working position shown in FIG. 2 facing a surface of an image carrier constituted of the photoconductor 5 and a recessed position shown in FIG. 6 separated from the photoconductor 5 by a larger distance than when the transfer device is in the working position. With this arrangement, when the transfer roller 11 is brought to the recessed position, a relatively large space S for clearing a jammed sheet P is formed between the photoconductor 5 and the transfer roller 11.

Further, because the support element hold device 49 holds the support member 13 to hold the transfer device constituted of the transfer roller 11 in the working position shown in FIG. 2 and moves to a position to allow the support member 13 to rotate, namely a lying position shown in FIG. 6, when moving the transfer roller 11 to the recessed position shown in FIG. 6, the transfer roller 11 can be held reliably in the working position and also can be moved to the recessed position without any problem. In addition, because the transfer device constituted of the transfer roller 11 is mounted to the second support element 27 which is provided in the free end side of the support member 13, when the first and the second support elements 26 and 27 are rotated to the second position shown in FIG. 6, the transfer roller 11 is separated from the photoconductor 5 by a relatively large distance and a large space S can be formed securely between the transfer roller 11 and the photoconductor 5.

Further, as shown in FIGS. 2 and 6, below the photoconductor 5 is located a base plate 61 which is fixed to the side plates 30 and 31 of the main body 1 as shown in FIG. 5. When the transfer roller 11 is in the recessed position shown in FIG. 6 the second support element 27 is supported by the base plate 61 which is located below the photoconductor 5. In an example shown in FIG. 6, the support member hold device 49 in a lying position is supported by the base plate 61, on which the second support element 27 is placed and the second support element 27 is supported by the base plate 61 via the support element hold device 49. However, the second support element 27 may be supported directly by the base plate 61.

As described above, because the second support element 27 is supported by the base plate 61, the second support element 27 rotates in a direction and is therefore folded relative to the first support element 26 and to narrow an angle formed by each side of the first and the second support elements 26 and 27 facing the photoconductor 5. Namely, when the transfer roller 11 is brought to the recessed position, the second support element 27 can be folded positively relative to the first support element 26. With such a folding or pivoting of the second support element 27 relative to the first support element 26, even when the apparatus is relatively small in size and a space between the photoconductor 5 and the base plate 61 is required to be relatively narrow, a relatively large space S can be formed between the transfer roller 11 and the photoconductor 5.

In addition, when the transfer roller 11 is in the recessed position as shown in FIG. 6, a relative position between the second support element 27 and the base plate 61 is so set that the second support element 27 takes a posture substantially in parallel with the base plate 27, a substantially horizontal posture in an example shown in FIG. 6. Therefore, the second support element 27 bends relative to the first support element to form an L shape, thus forming a maximum space between the transfer roller 11 in the recessed position and the photoconductor 5.

Conventionally, as shown by a dotted line in FIG. 6, the support member 130 supporting the transfer roller 110 is not divided into two pieces and is constituted by one piece. Therefore, even when the support member 130 is moved to the second position separated from the photoconductor 5 as shown in FIG. 6, a large space for clearing a jammed sheet P cannot be formed between the transfer roller 110 and the photoconductor 5, and consequently it is difficult to take out a sheet P which is jammed between the transfer roller 110 and the photoconductor 5 and further there exists a possibility that an operator touches the transfer roller 110 and the photoconductor 5 with his or her hands and clothes. In contrast, an image forming apparatus of the present invention forms a relatively large space for clearing a jammed sheet as described above.

As a transfer device, other than the transfer roller 11 as used in this embodiment, a corona charger performs charges corona charging towards the photoconductor 5 to separate a sheet P from the photoconductor 5 may be employed. Such a corona charger faces a surface of the photoconductor 5 in a position separated from the photoconductor 5.

On the other hand, a transfer device constituted of the transfer roller 11 as the present embodiment contacts a surface of the photoconductor 5 via a sheet P and rotates as shown in FIG. 2 when transferring a toner image. Namely, the transfer roller 5 contacts a surface of the photoconductor 5 directly or via a sheet P. Therefore, if an alien substance such as oil is adhered on a surface of the transfer roller 11 for some reason, such an alien substance is transferred to a surface of the photoconductor 5 and causes image quality of a toner image formed on the photoconductor 5 to be deteriorated. Therefore, when the transfer roller 11 is used, it is very important to prevent an alien substance such as oil from being deposited on the transfer roller 11.

In this respect, in the image forming apparatus of the present invention, because a relatively large space is formed between the transfer roller 11 and the photoconductor 5 when the transfer roller 11 is in the recessed position as described above, an operator can easily avoid touching the transfer roller 11 and consequently, the transfer of an alien substance such as oil to the transfer roller 11 is prevented. As a result, the transfer of an alien substance to the photoconductor 5 and the deterioration of the quality of toner image is prevented. Thus, the above-mentioned construction of the support member 13 including the first support element 26 and the second support element 27 is particularly effective when the transfer device is a transfer roller.

FIG. 5 is a perspective drawing illustrating a state in which the image forming unit 2 shown in FIG. 2 is withdrawn through the front and removed from the main body 1 of the apparatus. Further the second support element 27 is detached from the first support element 26 in the second position. As shown in the drawing, the side plate 30 at the front side of the main body 1 of the apparatus is covered by an inner cover 62 made of, for example, a plastic for safety of an operator and from an authentic view point. Namely, the inner cover 62 covers a lower part of the front side plate 30 dividing an opening 63 formed in the front side plate 30.

In FIG. 6, an upper end part 62*a* of the inner cover 62 is indicated schematically by a two-dot broken line, and as shown in the drawing, a relative position between the second support element 27 and the inner cover 62 is so set that an upper portion 11*a* of the transfer roller 11 is positioned at approximately the same height as the upper end part 62*a* of the inner cover 62 when a transfer device implemented by the transfer roller 11 is in the recessed position and separated from the photoconductor 5. Here, an approximately same height means that the upper portion 11*a* of the transfer roller 11 is within a range of 5 mm at a maximum above and below relative to the upper end part 62*a* of the inner cover 62. In other words, the upper portion 11*a* of the transfer roller 11*a* is positioned within plus or minus 5 mm above or below relative to the upper end part 62*a* of the inner cover 62.

If the upper portion 11*a* of the transfer roller 11 in the recessed position is positioned in a position as mentioned above relative to the upper end part 62*a* of the inner cover 62, the transfer roller 11 will not project above and far from the inner cover 62. Namely, the transfer roller 11 hidden behind the inner cover 62. Therefore, when an operator inserts his hands into the space S through the opening 63 provided at the front side of the main body 1 for clearing a jammed sheet P, the touching of the transfer roll 11 by the operator's hands and cloths is securely prevented. Consequently, it is prevented that the operator stains his hands and clothes by toner adhering on the transfer roller 11 and conversely, oil and dirt on the hands of the operator are prevented from being transferred to the surface of the transfer roller 11.

As shown in FIGS. 2, 5 and 6, a projection 64 is provided on the base plate 61 of the main body 1 of the apparatus projecting upwardly. The projection 64 can be formed integrally with the base plate 61 or by fixing a plate-shaped piece or the like to the base plate 61. With provision of the projection 64, when rotating the first and the second support elements 26 and 27 from the first position shown in FIG. 2 to the second position shown in FIG. 6, the support elements 26 and 27 are enabled to fold or pivot relative to each other smoothly and securely as shown in FIG. 6.

Figure 10:
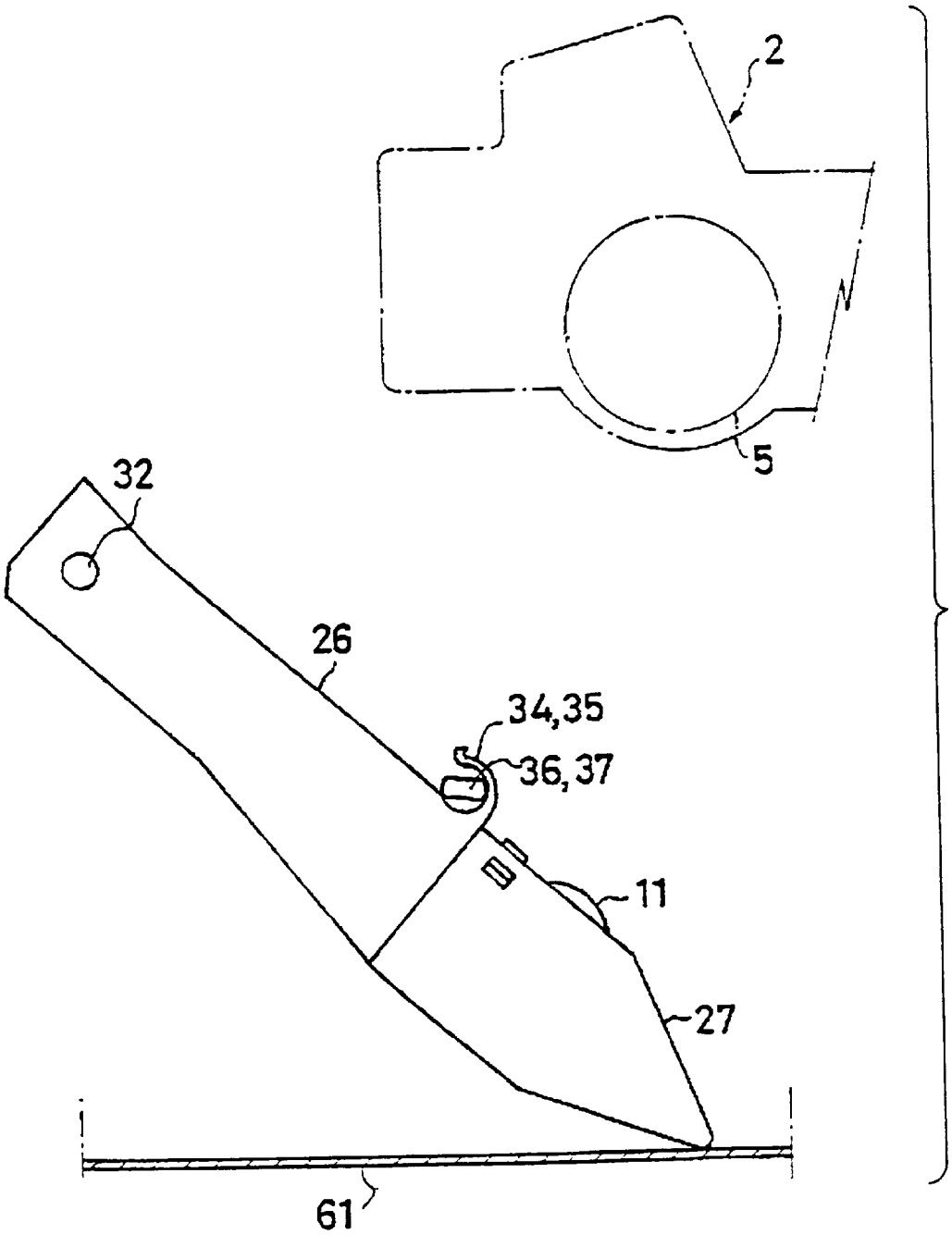
FIG. 10 is a schematic drawing illustrating an interim state of moving the first and the second support elements from a working position to a recessed position in an image forming apparatus which is not provided with a projection to a base plate.

FIG. 10 is a schematic drawing illustrating an interim state of moving the transfer roller 11 from the working position to the recessed position in an image forming apparatus which is not provided with a projection to the base plate 61. When the transfer roller 11 moves to a position near the recessed position as shown in the drawing, a tip end part of the second support element 27 contacts an upper plane of the base plate 61 with a relatively large contact area. At this time, due to a reaction force from the base plate 61, the second support element 27 tends to rotate in a clockwise direction in FIG. 10 around the connecting pins 36 and 37 relative to the first support roller 26. However, because the tip end part of the second support element 27 contacts the upper plane of the base plate 61 with a relatively large contact area, a relatively large frictional force is given to the second support element 27 by the base plate 61. As a result it occurs that the second support element 27 does not rotates relative to the first support element 26 and stops at a position shown in FIG. 10. In such a case, an operator needs to push the first and the second support elements 26 and 27 from above to rotate them to the second position shown in FIG. 6, which makes the job of the operator relatively complicated.

In contrast, if the projection 64 is provided on the base plate 61 as shown in FIGS. 2 and 6, when the transfer roller 11 moves to a position near the recessed position from the working position as shown in FIG. 9, first a bottom part of the second support element 27, a rib 65 which is constituted of a thin plate and is provided to the bottom part of the second support element 27 in this embodiment, contacts a tip end of the projection 64. At this time, because a contact area between these two elements is relatively small, a frictional force given to the second support element 27 is reduced. Consequently, due to a reaction force from the base plate 64, the second support element 27 pivots effectively relative to the first support element 26. Namely, rotation of the second support element 27 relative to the first support element in a direction to narrow an angle formed by each side of the first and second support elements 26 and 27 facing the photoconductor 5 is accelerated, enabling the first and the second support elements 26 and 27 to move smoothly to the second position shown in FIG. 6 without requiring that the operator push the first and the second support elements 26 and 27 downwardly by his hands.

As described above, the image forming apparatus according to the present invention is provided with means for reducing a frictional force which works on the second support element 27 from the main body side of the apparatus for accelerating rotation of the second support element 27 relative to the first support element 26 in a direction to narrow an angle formed by each side of the first and the second support elements 26 and 27 facing the photoconductor 5 when the transfer device implemented as the transfer roller 11 moves to a position near the recessed position from the working position. In the example shown in the drawing, the projection 64 provided at the base plate 61 constitutes the above-mentioned frictional force reducing means.

Alternatively, it may be so constructed that the second support element 27 is provided with a rotatable roller (not shown in the drawings) at its tip end. When the transfer roller 11 moves to a position near the recessed position as shown in FIG. 9, a frictional force given to the second support element 27 from the base plate 61 is reduced by bringing the above-mentioned roller into contact with the base plate 61 to rotate. In this case, the roller constitutes the frictional force reducing means.

When the first and second support elements 26 and 27 are in the first position and as a consequence the transfer roller 11 is in the working position, as explained earlier referring to FIG. 7 the gear 46 on the shaft of the transfer roller 11 engages with the gear 58 which is integrally fixed to the photoconductor 5 and rotation of the photoconductor 5 is conveyed to the transfer roller 11. Further, because the first support element 26 is rotatably mounted to the main body of the apparatus and the second support element 27 and the first support element 26 are engaged with each other rotatably relative to each other, the second support element 27 tends to be dislocated in a backward and forward direction relative to the main body of the apparatus, namely in an axial direction of the transfer roller 11. Therefore, when the photoconductor 5 rotates, engagement of the above-mentioned gears 46 and 58 becomes unstable and the second support element 27 and the transfer roller 11 are dislocated relative to the photoconductor 5 in an axial direction of the photoconductor 5. This causes a hollow transfer phenomenon in which a part of a toner image on the photoconductor 5 is not transferred to a sheet to occur to result in deteriorating image quality of a toner image on a sheet.

Therefore, in the image forming apparatus according to the present invention, a positioning hole 66 is formed in the second support element 27 as shown in FIG. 7, a positioning pin 67 is provided projecting from the unit case 4 of the image forming unit 2 and when the transfer roller 11 is in the working position and the first and the second support elements 26 and 27 are held in the first position, the positioning holes 66 and the positioning pins 67 engage with each other, thereby preventing the second support element 27 which is integral with the transfer roller 11 from being dislocated in an axial direction of the transfer roller 11. With such prevention of dislocation of the second support element 27 and the transfer roller 11, hollow transfer phenomenon is prevented from occurring and the quality of an image of a toner image transferred to a sheet is improved.

Thus, the image forming apparatus according to the present invention includes means for positioning the second support element 27 relative to the main body of the apparatus when a transfer device implemented using a transfer roller 11 is in the working position. Also, in the example shown in the drawings, the positioning holes 66 and the positioning pins 67 constitute such positioning means. In this example, the second support element 27 is positioned relative to the main body of the apparatus by inserting or engaging the positioning pins 67 with the positioning holes 66 to the image forming unit 2, and positioning the second support element 27 relative to the image forming unit 2. However, it may be so constructed that the second support element 27 is positioned directly relative to the main body of the apparatus.

During an image forming operation, the first and the second support elements 26 and 27 are in the second position as explained previously referring to FIG. 2, and at this time an upper plane of the second support element 27 serves as a guide to guide a sheet P conveyed to the transfer area 20 between the transfer roller 11 and the photoconductor 5. Namely, the second support element 27 constitutes a first guide plane 68 which guides a sheet P conveyed to the transfer area 20 between the transfer device constituted by the transfer roller 11 and the image carrier constituted by the photoconductor 5.

Similarly, an upper plane of the first support element 26 in the first position shown in FIG. 2 guides a sheet P which passes the transfer area 20. Namely, the first support element 26 constitutes a second guide plane 69 to guide a sheet P which passes the transfer area 20 between the transfer device constituted by the transfer roller 11 and the image carrier constituted by the photoconductor 5.

Because the first and the second support elements 26 and 27 constituting the support member 13 supporting the transfer roller 11 work also as guide members to guide a sheet P as described above, the number of parts of the apparatus is reduced accordingly and the construction can be simplified to accomplish reduction of cost of the apparatus.

In this embodiment, the transfer device is constituted by the transfer roller 11 and the upper plane of the first support element 26 constitutes the second guide plane 69. Further, as shown in FIG. 2, a common tangent line T contacting the transfer roller 11 and the photoconductor 5 in the transfer area 20 crosses the second guide plane 69 of the first support element 26 at a crossing point Q. A part 69*a* of the second guide plane 69 in the upper stream of the crossing point Q in a traveling direction of a sheet P is in a position below the common tangent line T and the transfer area 20 and a part 69*b* of the second guide plane 69 in the downstream of the crossing point Q in the traveling direction of a sheet P is in a position above the common tangent line T.

With the above-mentioned construction, a leading edge of a sheet P which passes the transfer area 20 touches the second guide plane 29 at the crossing point Q or a point near the crossing point Q and a traveling direction of the sheet P is regulated by the second guide plane 29. Thereafter the sheet P travels along the plane of the second guide plane 29 closely contacting the part 69*b* of the second guide plane 69 in the downstream of the crossing point Q. Thus, a sheet P which passes the transfer area 20 is guided smoothly to the second guide plane 69 and further conveyed smoothly over the guide plane 69. Consequently an occurrence of jamming of a sheet P is prevented.

As described earlier, a transfer device which is constituted by, for example, the transfer roller 11 shown in the drawings or a corona charger, when used for a long period of time, deteriorates in its property. If such a deteriorated transfer device is continued to be used, an abnormal or unacceptable image is produced. Therefore, the transfer device needs to be regularly, or when occasion arises, cleaned and checked, or be replaced with a new device.

Conventional image forming apparatuses are therefore so constructed so that a transfer device is separated from its support member by pulling the transfer device towards the front side relative to a main body of the apparatus and is mounted to the support member of the transfer device by pushing back the transfer device toward the rear side relative to the main body of the apparatus. Namely, an operator pulls the transfer device towards the front side relative to the main body of the apparatus when cleaning or checking the transfer device or replacing the device with a new device. With the above-mentioned construction, however, as explained earlier, it is necessary to contain the transfer device in a holding case which is a separate unit from the support member for the transfer device and to mount the holding case detachably to the support member for the transfer device in order to make the transfer device detachable from the support member. Therefore, the number of parts increases and consequently cost of the apparatus inevitably rises. If the support member 13 is constituted by the first support element 26 and the second support element 27 as the embodiments described herein, in addition to the first and the second support elements 26 and 27, a holding case for the transfer device is necessary. Consequently, cost of the apparatus further rises.

Therefore, in the image forming apparatus of this invention, in addition to constructing the support member 13 with the first support element 26 and the second support element 27 as described above, the second support element 27 is also constructed to be detachably connected to the first support element 26. Namely, the support member 13 supporting a transfer device includes the first support element 26 rotatably mounted to the main body 1 of the apparatus, and the second support element 27 to which the transfer device is mounted so as to move the transfer device between a working position facing a surface of an image carrier implemented as the photoconductor 5, and a recessed position separated from the photoconductor 5 by a larger distance than when the transfer device is in the working position. The second support element 27 constitutes the guide plane 68 for a recording medium which is a conveyed sheet P and is detachably connected to the second support element 27.

As described earlier, the first support element 26 is rotatably mounted to the main body 1 of the apparatus around the base end part of the support element 26 which is at the downstream side of the transfer roller 11 in a traveling direction of a sheet P. However, the first support element 26 may be movably mounted to the main body 1 of the apparatus movably relative to the main body 1 of the apparatus by rotatably mounting the first support element 26 at the rear part of the support element 26 relative to the main body 1 around the rear part of the support element 26, or by mounting the first support element 26 in a way that the first support element 26 is movable in a parallel direction with the photoconductor 5.

With the above-mentioned construction, when cleaning, checking or replacing the transfer roller 11, an operator can remove the second support element 27 from the first support element 26 and perform necessary work. Namely, because the second support element 27 supporting the transfer roller 11 is detachable from the first support element 26 integrally with the transfer roller 11, the second support element 27 serves as a holding case which is necessary when the transfer roller 11 is so constructed as to be slidable and detachable relative to its support element. Therefore, such a holding case can be eliminated in the above-mentioned construction, and accordingly a reduction of the number of parts and reduction of cost of the apparatus are achieved. Further, because the second support element 27 supporting the transfer roller 11 constitutes the guide plane 68 for a sheet P, it is not necessary to provide a support member to support the transfer roller 11 and a guide member for a sheet P individually as explained earlier, and reduction of cost of the apparatus and simplification of construction of the apparatus are both achieved.

As a method of connecting the first support element 26 and the second support element 27, there are provided a wide varieties of methods. For example, the second support element 27 may be so constructed to be removed from the first support element 26 by connecting the second support element 27 to the first support element 26 slidably in a backward and forward direction relative to the main body of the apparatus, and pulling the second support element 27 towards the front side of the apparatus as indicated by an arrow R in FIG. 3, or by connecting the first and the second support elements 26 and 27 detachably by means of a connecting device which is not shown in the drawings, such as a magnet.

However, if a magnet is used for such connection, the cost of the apparatus rises. Further, an operation of detaching the second support element 27 from the first support element 26 becomes relatively complicated. If the second support element 27 is connected to the first support element 26 slidably, when pulling the second support element 27 to the front side of the apparatus, there is a possibility that the second support element 27 interferes with the front side plate 30 of the main body 1 of the apparatus and that an operation of pulling the support element 27 to the front side of the apparatus becomes difficult.

Therefore, in the image forming apparatus of this invention, taking advantage of the first support element 26 and the second support element 27 being rotatably connected to each other, the second support element 27 is so constructed as to be detachable from the first support element 26 utilizing a connecting device connecting the first and the second support elements 26 and 27.

Namely, as shown in FIGS. 2 and 6, the first support element 26 is rotatably mounted to the main body 1 of the apparatus at one end side. Further, the second support element 27 is rotatably mounted to a free end side of the first support element 26 so that the first and the second support elements 26 and 27 move to a first position where the transfer device constituted by the transfer roller 11 is in the working position, and a second position where the transfer roller 11 is in the recessed position and the second support element 27 rotates relative to the first support element 26 in a direction that an angle formed by each side of the first and the second support elements 26 and 27 facing the photoconductor 5 respectively is narrowed when the first and the second support elements 26 and 27 are in the second position separated from the image carrier constituted by the photoconductor 5 than when the first and the second support elements 26 and 27 are in the first position. With this arrangement, a relatively large space S for clearing a jammed sheet P is formed between the photoconductor 5 and the transfer roller 11. In this embodiment, the above-mentioned construction is further advanced and the connecting device detachably connecting the second support element 27 to the first support element 26 is so constructed as to be detachable only when an angle formed by the first and the second support elements 26 and 27 becomes narrower than the angle formed when the first and the second support elements 26 and 27 are in the second position.

Figure 11A:
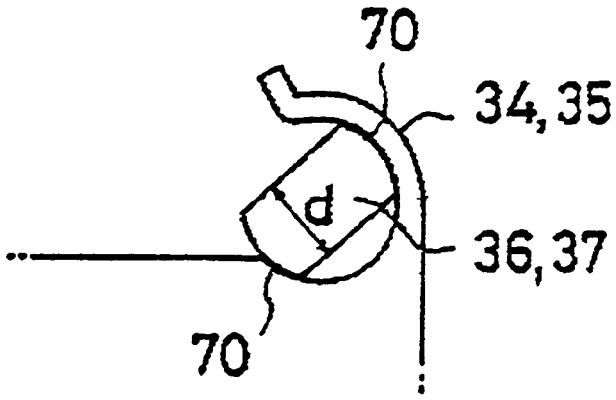
FIG. 11(*a*) is a schematic drawing illustrating a state in which a connecting pin is engaged with a receiving part and cannot be removed from the receiving part.
Figure 11B:
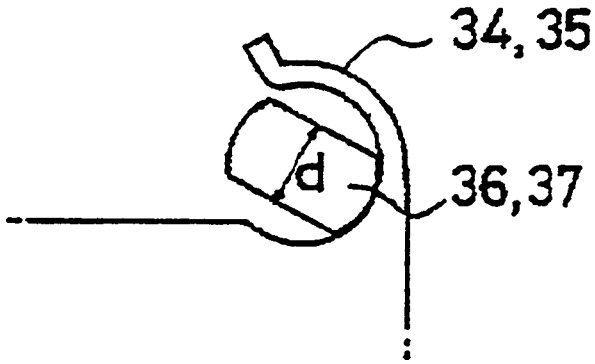

In detail, as explained previously referring to FIG. 4, the connecting device connecting the first support element 26 and the second support element 27 includes the arc-shaped receiving parts 34 and 35 of the first support element 26 and the connecting pins 36 and 37 integrally projecting from the second support element 27, the connecting pins 36 and 37 being formed in an oval shape with a width d as shown in FIGS. 11(*a*) and 11(*b*). When the first and the second support elements 26 and 27 are is in an interim position between the first position shown in FIG. 2 and the second position shown in FIG. 6, the connecting pins 36 and 37 engage with the arc-shaped receiving parts 34 and 35 with longitudinal ends 70 of the connecting pins 36 and 37 respectively contacting internal sides of the receiving parts 34 and 35 as shown in FIG. 11(*a*). Therefore, while the connecting pins 36 and 37 are rotatable relative to the receiving parts 34 and 35, these connecting pins and receiving parts are not detachable from each other, and accordingly, the second support element 27 freely rotates undetachably relative to the first support element 26.

After bringing the first and the second support elements 26 and 27 to the second position shown in FIG. 6, keeping the first support element 26 in a stopped position, the second support element 27 is rotated relative to the first support element 26 in a counter-clockwise direction in FIG. 6. In other words, the second support element 27 is rotated in a direction that an angle formed by the first and the second support elements 26 and 27 becomes narrower than an angle formed when the first and the second support elements 26 and 27 are in the second position. Then, when the second support element 27 is rotated to a position shown in FIG. 12, the width d of the connecting pins 36 and 37 conforms with an upper opening of the receiving parts 34 and 35 as shown in FIG. 11(*b*).

Figure 12:
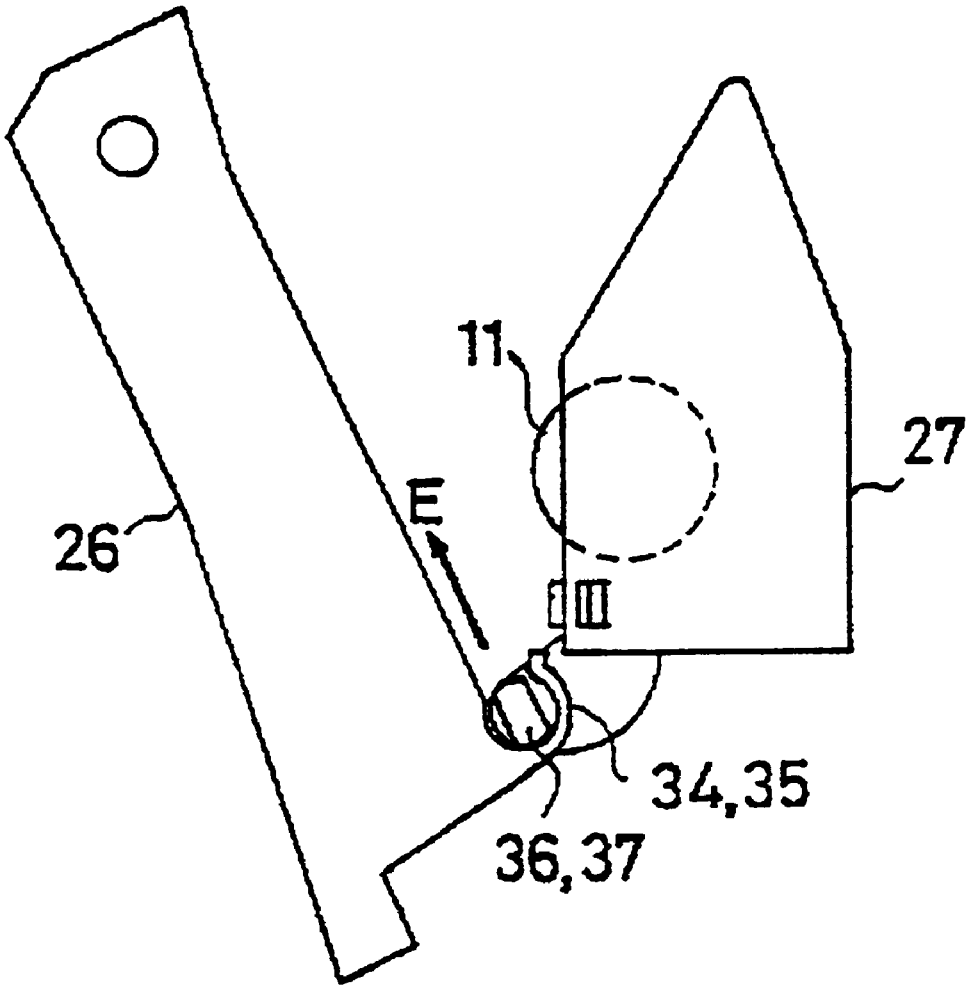
FIG. 12 is a schematic drawing illustrating a state in which the second support element is being detached from the first support element.

If the second support element 27 is then lifted upwards as indicated by an arrow E in FIG. 12, the second support element 27 is removed from the first support element 26. Thus, the second support element 27 removed from the first support element 26 can be pulled to the front side of the apparatus through the opening 30 of the front side plate 30 of the main body 1 of the apparatus shown in FIG. 5 and be taken out of the main body 1 of the apparatus completely. With a reverse operation, the second support element 27 can be connected to the first support element 26.

As described above, the connecting device constituted by the connecting pins 36 and 37 and the receiving parts 34 and 35 enables the first and the second support elements to be detached from each other only when an angle formed by the first and the second support elements 26 and 27 is narrower than the angle formed when the first and the second support elements 26 and 27 are in the second position. During a normal image forming operation or when clearing a jammed sheet, there will not occur that the second support element 27 is erroneously removed from the first support element 26 because the second support element 27 will not come to the position shown in FIG. 12 during a normal image forming operation or when clearing a jammed sheet.

With the above-mentioned construction, the second support element 27 can be removed from or connected to the first support element 26 without interfering with the front side plate 30 of the main body 1 of the apparatus because the second support element 27 is not constructed in a way to be slid to the front side of the apparatus to be removed from the first support element 26. Further, because the connecting device rotatably connecting the first and the second support elements 26 and 27 is utilized to constitute the connecting device to connect the first and the second support element 26 and 27 detachably, other elements such as a magnet are not necessary. As a result, simplification of construction and reduction of cost are accomplished and an operation of detaching is easy.

In addition, because the second support element 27 can be detached from the first support element 26 after bringing the second support element 27 to the second position separated from the photoconductor 5 by a relatively large distance, an operation of detaching is easy.

After detaching the second support element 27 from the main body 1 of the apparatus as described above, if the transfer roller 11 is lifted upwards relative to the axis receivers 40 and 41 shown in FIGS. 2 and 4, a pair of claws constituting the axis receiver are open and support parts 42 and 43, respectively. Therefore, the transfer roller 11 can be removed from the axis receivers 40 and 41 and then removed from the second support element 27 easily. Thus, cleaning, checking and replacement of the transfer roller 11 can be easily performed. With a reverse operation, the transfer roller 11 can also be easily engaged with the axis receivers 40 and 41.

Thus, because the transfer device constituted by the transfer roller 11 is detachably mounted to the second support element 27, after removing the second support element 27 from the first support element 26 as described above, the transfer roller 11 can be removed from the second support element 27 for cleaning, checking or replacement with a new device. Alternatively, the entire second support element 27 including the transfer roller 11 mounted thereon may be replaced with a new one.

As previously explained, FIG. 5 shows a state in which the second support element 27 is detached from the first support element 26 and is removed from the main body of the apparatus through the opening 63 and the image forming unit is pulled to the front side and removed from the main body 1 of the apparatus. As shown in the drawing, if the second support element 27 is taken out of the main body 1 of the apparatus, a relatively large opening is formed inside of the main body of the apparatus, and therefore, various parts mounted to the rear side plate 31 of the main body 1 as shown in FIG. 5, such as for example a gear 71 to rotatably drive the photoconductor 5, a lever 72 to move the charging roller 6 shown in FIG. 2 to contact and be separated from the photoconductor 5, and a solenoid 73 to drive the lever 72 can be easily checked, repaired or replaced. In other words, maintainability of elements provided at the rear side of the main body 1 of the apparatus is enhanced.

When setting the second support element 27 which has been detached from the first support element 26 back to the first support element 26, the second support element 27 is inserted into inside of the main body 1 through the opening 63 provided at the front side of the main body 1 as shown in FIG. 5, and then a posture of the second support element 27 relative to the first support element 26 is made as shown in FIG. 12 to engage the connecting pins 37 at the rear side of the main body 1 with the receiving part 35 which is also at the rear side of the main body and further to engage the connecting pins 36 at the front side of the main body 1 with the receiving part 34 at the front side of the main body 1. When performing the above-mentioned operation, an operator stands at the front side of the main body 1 of the apparatus and engages the connecting pins 37 with the receiving part 34 which are both located at the rear side of the main body 1 looking into the rear side of the main body 1 from the front side. Therefore, it is rather hard to see the connecting pins 37 and the receiving parts to be engaged and an operation of engaging is relatively difficult.

Figure 13:
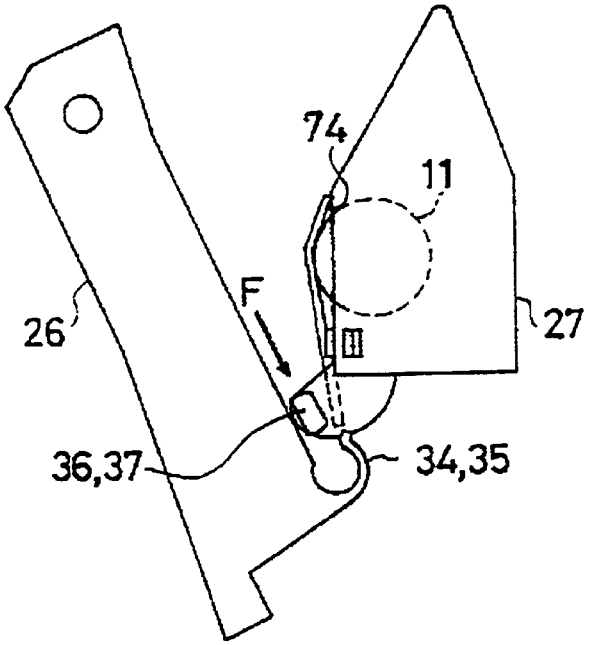
FIG. 13 is a schematic drawing illustrating a state in which second support element is being mounted to the first support element.

Therefore, in the image forming apparatus of this invention, there is provided a guide member which guides the second support element 27 when connecting the second support element 27 with the first support element 26 at the main body side of the apparatus. In the example shown in FIGS. 5 and 13, a guide member 74 is fixed to the rear side plate 31 of the main body 1. As shown in FIG. 13, when engaging the connecting pin 37 at the rear side with the receiving part 35, the connecting pin 37 is placed along a plane of the guide member 74 facing the first support element 26, and is then brought down in a direction indicated by an arrow F to engage with the receiving part 35. Thus, the connecting pin 37 at the rear side which is hard to be seen from the front side of the apparatus can be easily engaged with the receiving part 34. Namely, the second support element 27 is easily and precisely engaged with the first support element 26 with the above-mentioned construction.

A guide member for the front side connecting pin 36 is not provided in this embodiment because an operator can see the connecting pin 36 directly. However, a guide member may be provided also to the front side plate 30.

Figure 14:
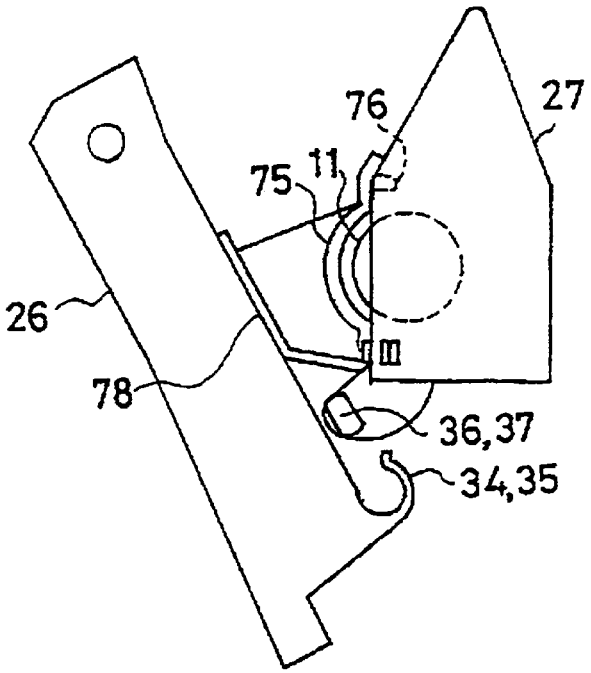
FIG. 14 is a schematic drawing illustrating an example in which a protecting cover for the transfer roller is used as a guide member.

Further, as shown in FIG. 14, a protecting cover 75 may be detachably provided on the second support element 27 for protecting the transfer roller 11 when the second support element 27 with the transfer roller 11 mounted thereto is delivered to an user. The protecting cover 75 shown in this embodiment is lightly hooked to the second support element 27 by hooking a hooking pin 76 provided on the cover 75 to a hooking hole formed in the second support element 27, so that the protecting cover 75 can be easily detached from the second support element 27.

The protecting cover 75 as mentioned above can be used instead of the guide member 74 as a guide member for guiding the second support element 27 when connecting the second support element 27 with the first support element 26. The second support element 27 with the protecting cover 75 is brought close to the first support element 26 bringing a plane 78 of the protecting cover 75 facing the first support element 26 into contact with the first support element 26 as shown in FIG. 14 and is then brought down along the first support element 26 to engage the connecting pins 36 and 37 with the receiving parts 34 and 35 respectively. The protecting cover 75 is detached from the second support element 27 when the second support element 27 is rotated to the second position shown in FIG. 6.

As described above, in this embodiment, the protecting cover 75 detachably mounted to the second support element 27 serves also as the guide member to guide the second support element 27 when connecting the second support element 27 with the first support element 26. The second support element 27 can be connected with the first support element 27 easily even with such a construction. Further, simplification of construction and reduction of cost are achieved by eliminating the guide member 74 as an exclusive guide member.

As described above, the second support element 27 is connected with the first support element 26 under guidance of the guide member 74 shown in FIG. 13 or the protecting cover 75 shown in FIG. 14However, when the second support element 27 is connected with the first support element 26 improperly, if an operator brings the second support element 27 to the second position shown in FIG. 6, rotates the first and the second support elements 26 and 27 to the first position shown in FIG. 2 and then starts an image forming operation, the transfer roller 11 does not contact the photoconductor 5 properly and such improper contact causes an abnormal image and jamming of a sheet to occur. In particular, because the connecting pin 37 and the receiving part 35 at the rear side are hard to be seen from the front side of the apparatus where the operator stands, there exists a possibility that the connecting pin 37 and the receiving part 35 are not engaged properly.

Therefore, in the image forming apparatus of this invention, there is provided an obstructing member which obstructs rotation of the first support element 26 when the second support element 27 is not connected properly with the first support element 26 at the main body side of the apparatus. For example, this obstructing member prevents the first support element 26 from being rotated to the first position.

In the example shown in the drawings, the aforementioned guide member 74 guiding the second support element 27 when connecting the second support element 27 with the first support element 26 serves also as the above-mentioned obstructing member. Namely, as shown in FIG. 13, when the connecting pin 37 at the rear side is not engaged with the receiving part 35 correctly, if the first support element 26 is rotated to the first position shown in FIG. 2, the connecting pin 37 interferes with the guide member 74 and the first support element 26 cannot be rotated to the first position. Consequently, the operator can immediately notice that the connecting pin 37 is not engaged with the receiving part 35 correctly and can redo a connecting operation. Thus, it is prevented that an image forming operation is performed when the second support element 27 is not correctly connected with the first support element 26 and occurrence of jamming of a transfer sheet and reproduction of an abnormal image is prevented.

Further, because the guide member 74 serves as the obstructing member also, construction of the apparatus is simplified and a cost of the apparatus is reduced.

As explained previously referring to FIG. 2, the image forming apparatus of this invention transfers a toner image formed on the image carrier constituted by the photoconductor 5 to a recording medium constituted by a sheet P with the transfer roller 11 as an example of the transfer device and then separates the sheet P from the photoconductor 5 by applying discharging to the sheet P with the discharging device 12. The discharging needle 14 of this discharging device also deteriorates in its property when used for a long time, and therefore needs to be cleaned, checked or replaced.

In order to meet such demand, as previously explained, in conventional image forming apparatuses, a transfer device and a discharging device are integrally assembled and are so constructed as to be freely detachable relative to a main body of the apparatus. With such a construction, however, it is troublesome when a cycle of cleaning and checking or a cycle of replacement is different between the transfer device and the discharging device. A cycle of cleaning and checking and a cycle of replacement are generally different between the discharging needle 14 of the discharging device 12 and the transfer roller 11, and normally the cycle of discharging needle 14 is shorter than that of the transfer roller 11. For example, when a replacement cycle of the transfer roller 11 is 100,000 copies, a replacement cycle of the discharging device 12 including the discharging needle 14 is 50,000 copies. In such a case, after making 50,000 copies, only the discharging device 12 needs to be replaced. However, if the transfer device and the discharging device are so constructed as to be integrally mounted and detached relative to the main body of the apparatus as in conventional image forming apparatus, the discharging device cannot be detached alone from the main body for replacement. If toner or paper dust is put on a tip end of the needle-shaped projection of the discharging needle 14, the discharging property of the discharging needle 14 deteriorates considerably. In such a case, only the discharging device 12 needs to be removed for cleaning the discharging needle 14. With a conventional image forming apparatus as mentioned above, removing only the discharging device is not possible.

An image forming apparatus in which a transfer device and a discharging device are individually detachable relative to a main body of the apparatus is also well known as explained earlier, and with such a construction, the discharging device can be individually removed from the main body. However, with this construction, because the discharging device and the transfer device cannot be detached integrally relative to the main body, when both the transfer device and the discharging device need to be replaced at the same time, an operation of detaching is relatively complicated. In the above-mentioned example, at completion of 100,000 copies, both the discharging device and the transfer device need to be replaced because the expected life span of each has expired. Even in such case, the transfer device and the discharging device are required to be detached individually, which makes an operation of detaching relatively complicated.

Thus, there are a case that both the transfer roller 11 and the discharging roller 12 are detached for replacement at the same time and a case that only the discharging device 12 is detached. However, conventional image forming apparatus do not allow both operations, detaching the transfer roller 11 and the discharging roller 12 integrally, and detaching the discharging roller 12 alone.

Therefore, in the image forming apparatus of this invention, the support member 13 supporting the transfer device constituted by the transfer roller 11 includes the first support element 26 movably mounted to the main body 1 of the apparatus, and the second support element 27 detachably connected to the first support element 26 and including the transfer roller 11 mounted thereto. Further, the discharging device 12 is detachably mounted to the discharging device mounting part 57 of the second support element 27.

With the above-mentioned construction, when replacing both the transfer roller 11 and the discharging device 12, the transfer roller 11 and the discharging device 12 are detached by detaching the second support element 27 from the first support element 26. Both the transfer roller 11 and the discharging device 12 can be mounted to the main body 1 of the apparatus by connecting the second support element 27, to which a new transfer roller 11 and a new discharging device 12 are mounted, with the first support element 26. Thus, the transfer device and the discharging device are detached and mounted easily and efficiently.

When detaching only the discharging device 12, the discharging device 12 is detached from the second support element 27, and then a new discharging device 12 is mounted to the second support element 27. Thus, the discharging device is detached individually without detaching the transfer roller 11.

In addition, in the image forming apparatus of this invention, the transfer device constituted by the transfer roller 11 is detachably mounted to the second support element 27, and the transfer roller 11 alone can be detached from the second support element 27. Namely, the transfer roller 11 alone can be detached from the second support element 27 for replacement, leaving the discharging device 12 as mounted to the second support element 27.

Next, a construction with respect to mounting the discharging device 12 to the second support element 27 and an example of an operation of mounting are explained.

As shown in FIGS. 4 and 8, a mounting hole 79 is formed at a rear part of the discharging device mounting part 57 of the second support element 27 and a hooking hole 80 is formed at a front wall part of the discharging device mounting part 57. A locking piece 81 is integrally formed at a front part of the plastic holder 15 of the discharging device 12, and a free end part of the locking piece 81 is elastically deformable around a base end part of the piece 81 which is integrally connected to the holder 15 in a direction indicated by an arrow G in FIG. 8.

When the discharging device 12 is mounted to the second support element 27, a rear end part of the holder 15 engages with the mounting hole 79 at the rear side of the second support element 27 and a projecting hooking claw 82 of the locking piece 81 of the holder 15 engages with a hooking hole 80 formed at the front side of the second support element 27. With such an engagement, the discharging device 12 is securely mounted to the second support element 27.

When detaching the discharging device 12 from the second support element 27, an operator holds the first and the second support elements 26 and 27 in the second position shown in FIG. 6 and then as shown in FIG. 8 holds and pushes a release lever 83 provided at a free end of the locking piece 81 towards the rear side as indicated by an arrow G and deforms the locking piece 81 to disengage the hooking claw 82 from the hooking hole 80. The operator then, holding the release lever 83, pivots the discharging device 12 about its rear side end as indicated by an arrow H in FIG. 8 and brings the discharging device 12 to a position indicated by a broken line in the drawing. Then, by pulling the discharging device 12 towards the front side, the rear side end of the discharging device 12 is disengaged from the hooking hole 79 and the discharging device 12 can be detached from the second support element 27.

When mounting the discharging device 12 to the second support element 27, the operator brings the first and the second support elements 26 and 27 to the second position shown in FIG. 6, engages the rear side end of the holder 15 of the discharging device 12 with the hooking hole 79 as indicated by the broken line in FIG. 8 and pushes down a front side end of the holder 15. With such an operation, the locking piece 81 is pressed to a front side wall of the second support element 27 to be elastically deformed and the hooking claw 82 engages with the hooking holes 80.

The discharging device 12 may also be detached and mounted relative to the first support element 26 with a procedure as mentioned above after detaching the second support element 27 from the first support element 26.

As described above, with a simple operation, the discharging device can be mounted to the second support element 27. However, in such an operation, due to an incomplete operation by an operator, it may occur that the first and the second support elements 26 and 27 are rotated to the first position shown in FIG. 2 despite the hooking hole 82 of the discharging device 12 not being completely engaged with the hooking hole. It is further conceivable that when clearing a jammed sheet, an operator accidentally unhooks or releases the discharging device mounted to the second support element 27, the hooking claw 82 is disengaged from the hooking hole 89 and in such a state the first and the second support element 26 and 27 are rotated to the first position. If an image forming operation is then performed, the reproducing of an abnormal image and jamming of a sheet can not be avoided.

Therefore, in the image forming apparatus of this invention, there is provided a pushing device which, when the discharging device 12 is not correctly mounted to the second support element 27, contacts the discharging device 12 and pushes the discharging device 12 to a correct position relative to the second support element 27 with movement of the first support element 26. In the example shown in the drawings, as shown in FIG. 7, a projecting part 84 of the unit case 4 of the image forming unit 2 constitutes such a pushing device.

If the first and the second support elements 26 and 27 are rotated to the first position from the second position when the hooking claw 82 of the discharging device 12 is out of engagement with the hooking hole 80 of the second support element 27, when the first and the second support elements 26 and 27 are moved to the first position, the projecting part 84 pushes the holder 12 of the discharging device 12 from above and the hooking claw 82 engages with the hooking hole 80 correctly. Thus, the discharging device 12 is mounted to the second support element 27 in a correct position. As described above, even when the discharging device 12 is not mounted correctly, when the first and the second support elements 26 and 27 are moved to the first position, the discharging device 12 is mounted correctly to the second support element 27 and the reproducing of an abnormal image and jamming of a sheet is prevented.

The pushing device like the above-mentioned projecting part 84 may be provided alternatively at the main body side of the apparatus.

Further, because the axis receiver support parts 42 and 43 supporting the axis receivers 40 and 41 of the transfer roller 11 are respectively constituted by a pair of support claws projectingly provided to the second support element 27 and when the photoconductor 5 rotates a pair of support claws at one end to be elastically deformed to a direction indicated by an arrow I in FIG. 2 due to pressure received via the transfer roller 11 from the photoconductor 5, there is a possibility that a support function of the axis receiver support parts 42 and 43 will become damaged.

Therefore, the image forming apparatus of this invention is so constructed that the discharging device 12 is provided at a position near the axis receiver support parts 42 and 43. With such a construction, even if the photoconductor 5 rotates and an external force is applied to one of the pairs of support claws constituting the axis receiver support parts 42 and 43, the discharging device 12 supports and prevents the pair of support claws from being greatly deformed in the direction indicated by the arrow I in FIG. 2. Thus, the axis receiver support parts 42 and 43 assuredly support the axis receivers 40 and 41.

Figure 16:
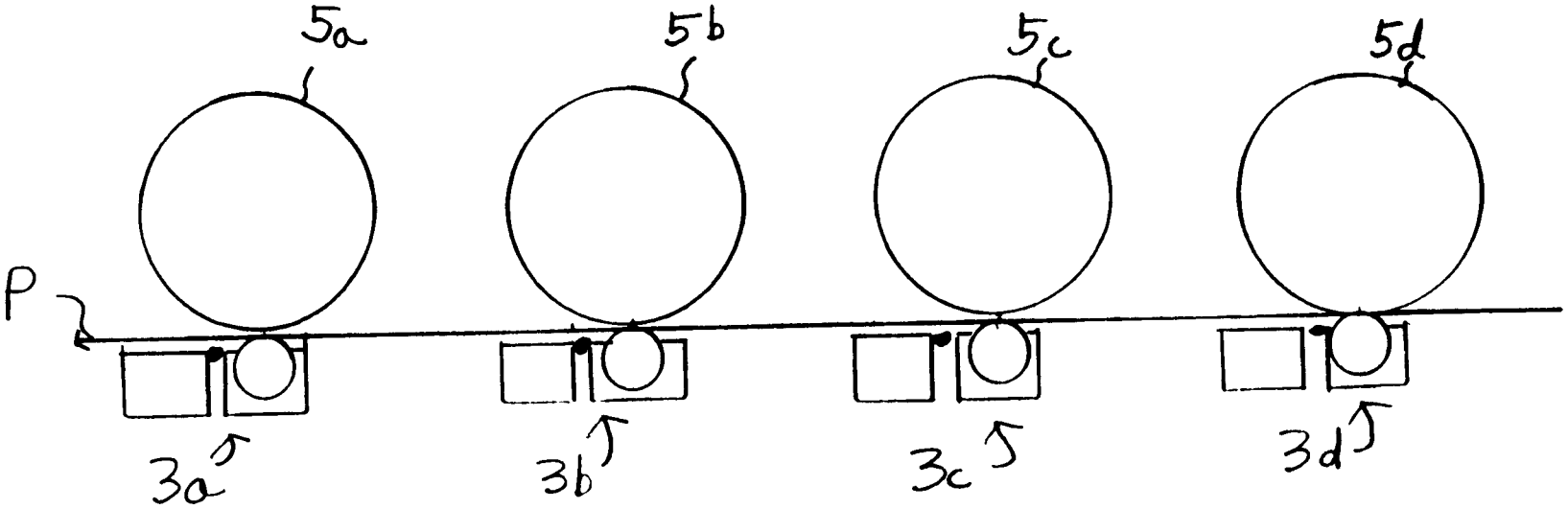
FIG. 16 illustrates a plurality of transfer devices of the present invention utilized in a multicolor image forming apparatus having four photoconductive drums.

FIG. 16 illustrates four transfer units 3*a*, 3*b*, 3*c*, and 3*d* constructed in accordance with the teachings of the present invention and utilized in a multicolor image forming apparatus. The four photoconductors 5*a*, 5*b*, 5*c* and 5*d* illustrated in FIG. 16 respectively forms a toner image of a different color such as black, cyan, magenta, and yellow respectively.

Figure 17:
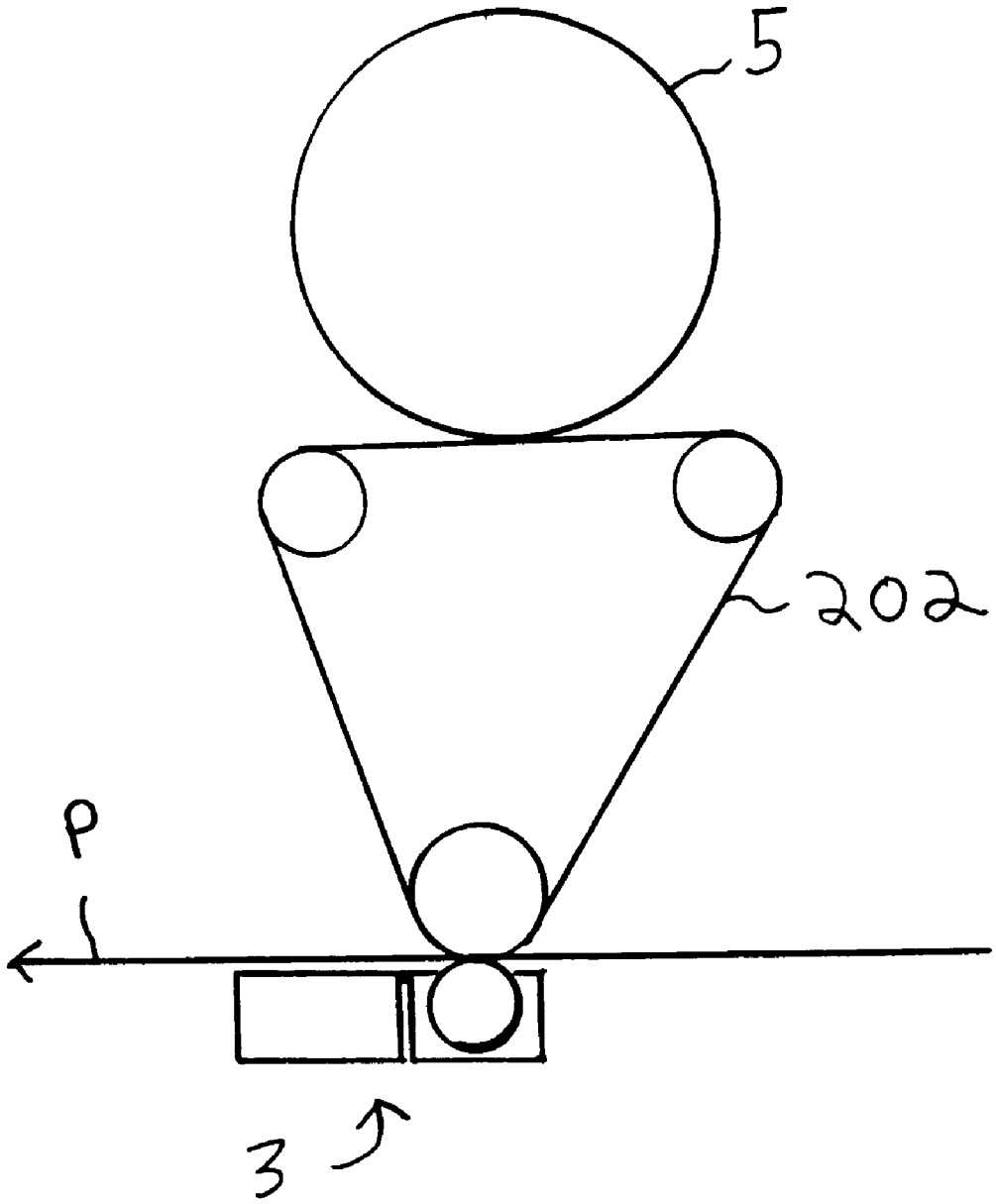
FIG. 17 illustrates the transfer device of the present invention in an embodiment which transfers toner images off of a belt.

FIG. 17 illustrates the present invention utilized with a belt 202 which transfers a toner image using the transfer unit 3. In the embodiment illustrated in FIG. 17, different color toner images are individually formed on the photoconductor 5 and transferred one on top of another to the belt 202. The belt 202, which functions as an intermediate transfer belt in this embodiment, then transfers the complete toner image using the transfer unit 3. As an alternative to the embodiment illustrated in FIG. 17, it is possible to omit the use of the photoconductor 5 and the belt 202 is implemented using a photoconductive belt.

Figure 18:
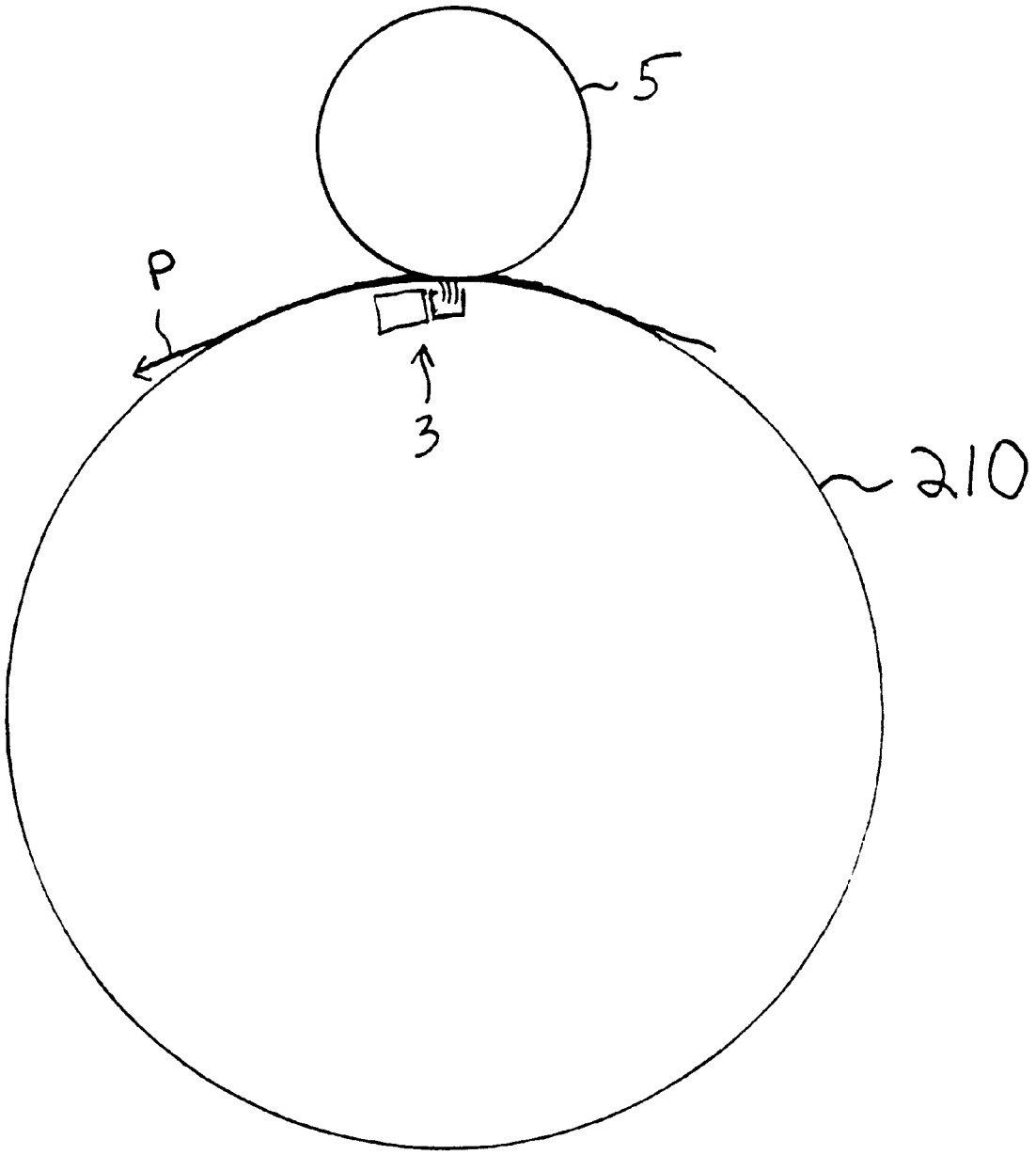
FIG. 18 illustrates a transfer device of the present invention disposed within a transfer drum 210.

FIG. 18 illustrates the transfer unit 3 of the present invention disposed within a transfer drum 210. The transfer drum 210 has an exterior surface formed of a dielectric sheet around a drum structure. The charges from the transfer unit 3 are passed through the dielectric material of the transfer drum 210 to the sheet P which receives the toner image from the drum 5.

Figure 19:
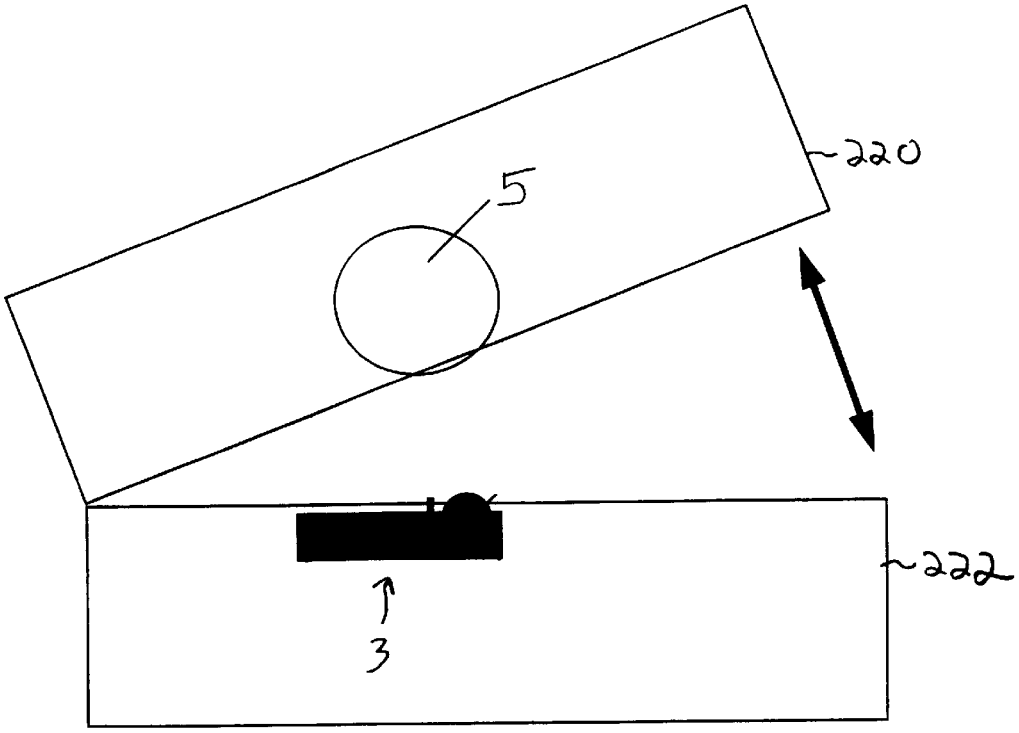
FIG. 19 illustrates an embodiment of the invention in which the photoconductor 5 is mounted to an upper section of an image forming apparatus which pivots away from a lower section.

FIG. 19 illustrates an embodiment of the invention in which the transfer unit 3 is mounted to a lower section 222 of an image forming apparatus. An upper section 220 of the image forming apparatus is pivotally mounted to the lower section 222 and includes the photoconductor 5.

Figure 20:
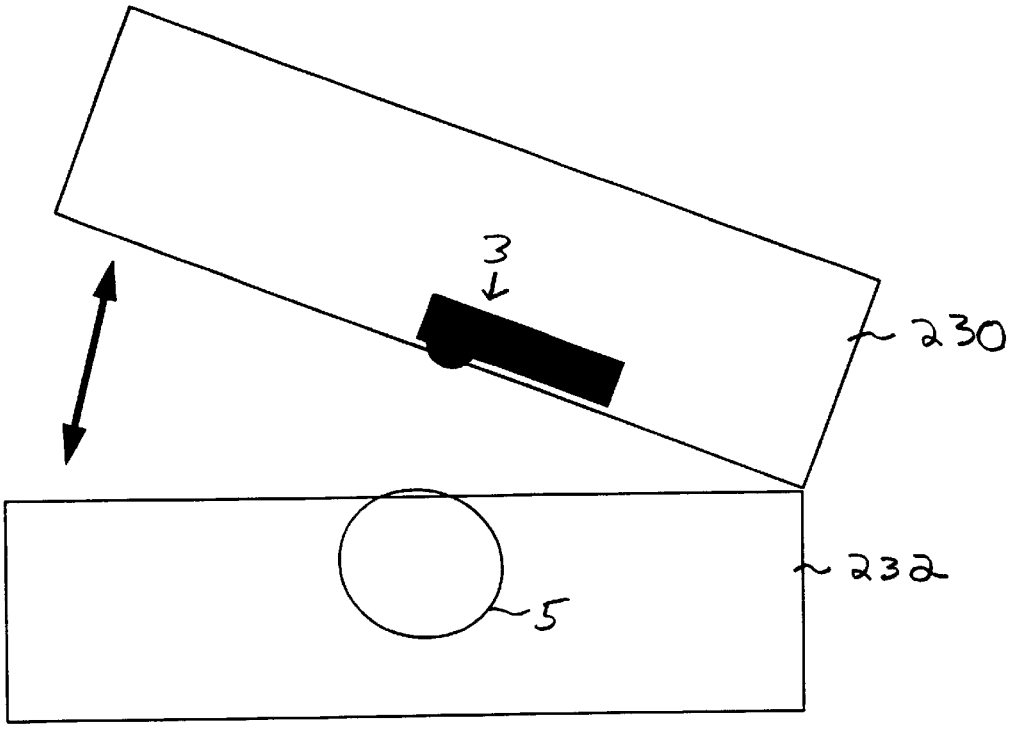
FIG. 20 illustrates another embodiment of the invention in which the transfer unit 3 is mounted to an upper section of an image forming apparatus.

FIG. 20 illustrates an embodiment of the invention in which an upper section of the image forming apparatus includes the transfer unit 3 and is pivotally mounted to a lower section 232 of the image forming apparatus which includes the photoconductor 5.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus, comprising:

an image carrier;

a transfer device which transfers an image formed on the image carrier to a recording medium; and a support member which supports the transfer device, the support member including a first support element having a first end pivotally mounted to a main body of the apparatus, and including a second support element pivotally mounted to a second end of the first support element which is opposite the first end of the first support element, the first support element having a furthest edge which is an edge which is furthest away from the first end thereof along a direction of travel of the recording medium, at least a portion of the second support element extending in the direction of travel of the recording medium beyond the furthest edge of the first support element, the second support element supporting the transfer device and being supported only by the first support element when in a working position for transferring the recording medium.

2. The image forming apparatus according to claim 1, wherein:

the second support element rotates relative to the first support element such that an angle facing the image carrier which is formed by the first and the second support elements facing the image carrier when the transfer device is in the working position is larger than the angle when the transfer device is in a recessed position.

3. The image forming apparatus according to claim 2, wherein:

when the transfer device is in the recessed position, the second support element is supported by a base plate of the main body of the apparatus, which is located below the image carrier.

4. The image forming apparatus according to claim 3, wherein a relative position between the second support element and the base plate causes the second support element to be substantially parallel to the base plate when the transfer device is in the recessed position.

5. The image forming apparatus according to claim 3, further comprising:

means for reducing a frictional force on the second support element from a side of the main body of the apparatus which eases rotation of the second support element relative to the first support element.

6. The image forming apparatus according to claim 1, further comprising:

a movable mechanical device which supports the support member in the working position and moves to allow movement of the support member from the working position to a recessed position.

7. The image forming apparatus according to claim 1, wherein:

the transfer device is mounted to the second support element.

8. The image forming apparatus according to claim 1, wherein:

the transfer device is a transfer roller which rotates due to a force imposed by the image carrier imposed through the recording medium when transferring the image from the image carrier to the recording medium.

9. The image forming apparatus according to claim 1, further comprising:

means for preventing the second support element from rotating and separating from the image carrier relative to the first support element when the transfer device is in the working position.

10. The image forming apparatus according to claim 1, further comprising:

an inner cover covering an opening at a front side of the apparatus, wherein a relative position between the second support element and the inner cover allows an upper part of the transfer device to be positioned at an approximately same height as an upper end of the inner cover when the transfer device is in a recessed position.

11. The image forming apparatus according to claim 1, further comprising:

means for positioning the second support element relative to the main body of the apparatus when the transfer device is in the working position.

12. The image forming apparatus according to claim 1, wherein:

the second support element is a first guide plane to guide the recording medium conveyed to a transfer area between the transfer device and the image carrier.

13. The image forming apparatus according to claim 12, wherein:

the first support element constitutes a second guide plane to guide the recording medium which passes the transfer area between the transfer device and the image carrier.

14. The image forming apparatus according to claim 13, wherein:

a tangent line contacting both the transfer device and the image carrier in the transfer area crosses the second guide plane of the first support element, a part of the second guide plane in the upper stream of the crossing point in a traveling direction of the recording medium is in a position below the tangent line and the transfer area and a part of the second guide plane downstream of the crossing point in the traveling direction is in a position above the tangent line.

15. The image forming apparatus according to claim 1, wherein:

the second support element is detachable from the first support element.

16. The image forming apparatus according to claim 15, wherein:

a connecting device detachably connecting the second support element to the first support element is detachable only when an angle formed by the first and the second support elements becomes narrower than an angle formed when the first and the second support elements are in a recessed position.

17. The image forming apparatus according to claim 15, further comprising:

a guide member at a main body side of the apparatus for guiding the second support element when connecting the second support element with the first support element at the main body side of the apparatus.

18. The image forming apparatus according to claim 15, wherein the second support element comprises:

a protecting cover detachably connected to the second support element which is a guide member and guides the second support element when connecting the second support element with the first support element.

19. The image forming apparatus according to claim 15, further comprising:

an obstructing member at a main body side for obstructing the first support element from rotating when the second support element is not correctly engaged with the first support element.

20. The image forming apparatus according to claim 18, further comprising:

an obstructing member at a main body side for obstructing the first support element from rotating when the second support element is not correctly engaged with the first support element, wherein the obstructing member is also the guide member.

21. The image forming apparatus according to claim 15, further comprising:

a discharging device, detachably mounted to the second support element, to apply a discharge to the recording medium to separate the recording medium from the image carrier.

22. The image forming apparatus according to claim 21, further comprising:

a pushing device which, when the discharging device is not correctly mounted to the second support element, contacts the discharging device and pushes the discharging device to a correct position relative to the second support element with movement of the first support element.

23. The image forming apparatus according to claim 22, wherein:

the transfer device is detachably mounted to the second support element.

24. An image forming apparatus according to claim 1, wherein:

a majority of the second support element extends beyond the furthest edge of the first support element.

25. An image forming apparatus, comprising:

an image carrier;

a transfer device which transfers an image formed on the image carrier to a recording medium; and a support member which supports the transfer device, the support member including a first support element having a first end pivotally mounted to a main body of the apparatus, and including a second support element pivotally mounted to a second end of the first support element which is opposite the first end of the first support element, the second support element supporting the transfer device, wherein when the support member is in a support position, a paper travel path is defined by a plane of the second support element, and when the support member is in a released position, the second support element is completely out of the paper path.

26. An image forming apparatus, comprising:

an image carrier;

a transfer device which transfers an image formed on the image carrier to a recording medium; and a support member which supports the transfer device, the support member including a first support element having a first end pivotally mounted to a main body of the apparatus, and including a second support element, defining a plane, pivotally mounted to a second end of the first support element which is opposite the first end of the first support element, the second support element supporting the transfer device, wherein when the support member is in a support position, a line of a paper travel path is defined, and when the support member is in a released position, the plane of the second support element is parallel to said paper path.

27. An image forming apparatus according to claim 26, wherein:

when the support member is in a released position, the plane of the second support element is parallel to said paper path such that a line is drawable from the paper path to the second support element which is perpendicular to both said paper path and the plane of the second support element.

28. An image forming apparatus, comprising:

an image carrier;

a transfer device which transfers an image formed on the image carrier to a recording medium; and a support member which supports the transfer device, the support member including a first support element having a first end pivotally mounted to a main body of the apparatus, and including a second support element pivotally mounted to a second end of the first support element which is opposite the first end of the first support element, the second support element supporting the transfer device and being supported only by the first support element when in a working position for transferring the recording medium, wherein the second support element rotates relative to the first support element such that an angle facing the image carrier which is formed by the first and the second support elements facing the image carrier when the transfer device is in the working position is larger than the angle when the transfer device is in a recessed position.

29. An image forming apparatus, comprising:

an image carrier;

a transfer means for transferring an image formed on the image carrier to a recording medium; and a support means for supporting the transfer means, the support means including a first support means having a first end pivotally mounted to a main body of the apparatus, and including a second support means pivotally mounted to a second end of the first support means which is opposite the first end of the first support means, the first support means having a furthest edge which is an edge which is furthest away from the first end thereof along a direction of travel of the recording medium, at least a portion of the second support means extending in the direction of travel of the recording medium beyond the furthest edge of the first support means, the second support means supporting the transfer means and being supported only by the first support means when in a working position for transferring the recording medium.

30. An image forming apparatus, comprising:

an image carrier;

a transfer means for transferring an image formed on the image carrier to a recording medium; and a support means for supporting the transfer means, the support means including a first support means having a first end pivotally mounted to a main body of the apparatus, and including a second support means pivotally mounted to a second end of the first support means which is opposite the first end of the first support means, the second support means supporting the transfer means, wherein when the support means is in a support position, a paper travel path is defined by a plane of the second support means, and when the support means is in a released position, the second support means is completely out of the paper path.

* * * * *